US007305928B2

(12) United States Patent
Bradley et al.

(10) Patent No.: US 7,305,928 B2
(45) Date of Patent: Dec. 11, 2007

(54) METHOD FOR POSITIONING A MARINE VESSEL

(75) Inventors: Eric Bradley, Columbus, IN (US); Richard Poorman, Columbus, IN (US)

(73) Assignee: Brunswick Corporation, Lake Forest, IL (US)

( * ) Notice: Subject to any disclaimer, the term of this patent is extended or adjusted under 35 U.S.C. 154(b) by 91 days.

(21) Appl. No.: 11/248,483

(22) Filed: Oct. 12, 2005

(65) Prior Publication Data

US 2007/0089660 A1 Apr. 26, 2007

(51) Int. Cl.
*B63H 25/10* (2006.01)
*B63H 25/02* (2006.01)

(52) U.S. Cl. ..... 114/144 R; 144/144 A

(58) Field of Classification Search ..... 144/144 A, 144/144 R, 144 B, 144 RE, 151; 440/1, 440/53, 84

See application file for complete search history.

(56) References Cited

U.S. PATENT DOCUMENTS

| | | | | |
|---|---|---|---|---|
| 5,108,325 | A | 4/1992 | Livingston et al. | 440/112 |
| 5,386,368 | A | 1/1995 | Knight | 364/432 |
| 5,735,718 | A | 4/1998 | Ekwall | 440/83 |
| 5,755,605 | A | 5/1998 | Asberg | 440/75 |
| 6,142,841 | A | 11/2000 | Alexander et al. | 440/38 |
| 6,230,642 | B1 | 5/2001 | McKenney et al. | 114/150 |
| 6,234,853 | B1 | 5/2001 | Lanyi et al. | 440/53 |
| 6,357,375 | B1 | 3/2002 | Ellis | 114/144 R |
| 6,386,930 | B2 | 5/2002 | Moffet | 440/41 |
| 6,431,928 | B1 | 8/2002 | Aarnivuo | 440/58 |
| 6,447,349 | B1 | 9/2002 | Fadeley et al. | 440/41 |
| 6,511,354 | B1 | 1/2003 | Gonring et al. | 440/87 |
| 6,623,320 | B1 | 9/2003 | Hedlund | 440/80 |
| 6,705,907 | B1 | 3/2004 | Hedlund | 440/51 |
| 6,712,654 | B1 | 3/2004 | Putaansuu | 440/53 |

(Continued)

FOREIGN PATENT DOCUMENTS

WO WO 03/042036 11/2002

(Continued)

OTHER PUBLICATIONS

"Compact Azipod Propulsion on DP Supply Vessels", by Strand et al., Thrusters Session of the Dynamic Positioning Conference, Sep. 18 & Sep. 19, 2001, 8 pages-(pages misnumbered).

(Continued)

*Primary Examiner*—Lars A. Olson
*Assistant Examiner*—Daniel V. Venne
(74) *Attorney, Agent, or Firm*—William D. Lanyi

(57) ABSTRACT

A vessel positioning system maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

53 Claims, 9 Drawing Sheets

U.S. PATENT DOCUMENTS

| | | | | |
|---|---|---|---|---|
| 6,783,410 | B2 | 8/2004 | Florander et al. | 440/51 |
| 6,790,109 | B1 * | 9/2004 | Heer et al. | 440/53 |
| 6,942,531 | B1 | 9/2005 | Fell et al. | 440/84 |
| 6,952,180 | B2 | 10/2005 | Jonsson et al. | 342/357.05 |
| 7,131,385 | B1 * | 11/2006 | Ehlers et al. | 144/145 R |
| 2003/0236036 | A1 | 12/2003 | Varis | 440/6 |
| 2004/0221787 | A1 | 11/2004 | McKenney et al. | 114/144 R |
| 2005/0263058 | A1 * | 12/2005 | Suemori et al. | 114/144 R |

FOREIGN PATENT DOCUMENTS

| | | |
|---|---|---|
| WO | WO 03/093102 | 4/2003 |

OTHER PUBLICATIONS

"New Thruster Concept for Station Keeping and Electric Propulsion", by Adnanes et al., Drives Session of the Dynamic Positioning Conference, Sep. 18 & Sep. 19, 2001, pp. 1-8 (plus cover sheet—9 pages total).

"Dynamically Positioned and Thruster Assisted Position Moored Vessels", by Professor Asgeir J. Sorenson, Dept. of Marine Technology, pp. 1-45.

Oxford Technical Solutions-RT3040, 3 pages, dated Sep. 30, 2005, website: http://oxts.com/search.asp?q=rt3042&Submit=Search.

* cited by examiner

METHOD FOR POSITIONING A MARINE VESSEL

CROSS REFERENCE TO CO-PENDING PATENT APPLICATION

This patent application is generally related to co-pending U.S. patent application Ser. No. 11/248,482, filed Oct. 12, 2005, by Bradley et al and assigned to the assignee of this patent application.

BACKGROUND OF THE INVENTION

1. Field of the Invention

The present invention is generally related to a method for positioning a marine vessel and, more particularly, a method for maintaining the position of a marine vessel at a selected global position, measured in terms of longitude and latitude, and a selected heading, measured as a compass angle.

2. Description of the Related Art

As will be described below, those skilled in the art are familiar with many different types of marine propulsion systems, including outboard motors, stemdrive systems, trolling motors, and devices which are rotatable about steering axes which extend downwardly through a bottom or lower surface of the hull of a marine vessel. In addition, those skilled in the art are familiar with various types of marine vessel maneuvering systems that can be used to maneuver a marine vessel during docking procedures. Those skilled in the art are also familiar with various types of joystick applications, some of which are associated with the control of a marine vessel.

U.S. Pat. No. 5,108,325, which issued to Livingston et al. on Apr. 28, 1992, discloses a boat propulsion device that mounts through a hole in a bottom surface of a boat. The engine is positioned inside the boat and the propeller drive is positioned under a bottom surface of the boat. The propulsion device includes a mounting assembly, a steering assembly rotatably connecting the drive to the mounting assembly for steering the propeller drive under the boat, a trimming assembly swingingly connecting the drive to the steering assembly for trimming/tilting of the propeller drive under the boat at any steered position, and a driveshaft means providing a drive connection between the engine and the propeller drive at any steered and trimmed position.

U.S. Pat. No. 5,386,368, which issued to Knight on Jan. 31, 1995, describes an apparatus for maintaining a boat in a fixed position. The apparatus includes an electric trolling motor disposed to produce a thrust to pull the boat, a steering motor disposed to affect the orientation of the electric trolling motor, a position deviation detection unit, and a control circuit. The position deviation detection unit detects a deviation in the position of the boat from the desired position and transmits signals indicative of a deviation distance (the distance from the boat to the desired position) and a return heading (the direction of the desired position from the boat) to the control unit.

U.S. Pat. No. 5,735,718, which issued to Ekwall on Apr. 7, 1998, describes a drive unit for a boat having an engine with a flywheel surrounded by a flywheel casing, a propeller drive housing connected to, but electrically insulated from, the flywheel casing, and an input shaft for the propeller drive housing which is driven and electrically insulated from the flywheel.

U.S. Pat. No. 5,755,605, which issued to Asberg on May 26, 1998, describes a propeller drive unit. Installation in a boat has two propeller drive units which extend out through individual openings in the bottom of a V-bottomed boat, so that the legs are inclined relative to each other. The leg of one drive unit can be set to turn the boat in one direction at the same time as the leg of the other drive unit can be set to turn the boat in the opposite direction, so that the horizontal counteracting forces acting on the legs cancel each other, while the vertical forces are added to each other to trim the running position of the boat in the water.

U.S. Pat. No. 6,142,841, which issued to Alexander et al. on Nov. 7, 2000, discloses a waterjet docking control system for a marine vessel. A maneuvering control system is provided which utilizes pressurized liquid at three or more positions of a marine vessel in order to selectively create thrust that moves the marine vessel into desired positions and according to chosen movements. A source of pressurized liquid, such as a pump or a jet pump propulsion system, is connected to a plurality of distribution conduits which, in turn, are connected to a plurality of outlet conduits. Electrical embodiments of the system can utilize one or more pairs of impellers to cause fluid to flow through outlet conduits in order to provide thrust on the marine vessel.

U.S. Pat. No. 6,230,642, which issued to McKenney et al. on May 15, 2001, describes an autopilot based steering and maneuvering system for boats. The steering system uses a specially integrated autopilot that remains engaged unless the operator is actively commanding the boat to change course. For example, in a boat in which steering is performed using a joystick, course changes can be affected simply by moving the joystick. The movement automatically disengages the autopilot, allowing the operator to achieve the course change. When the operator has completed the course change and released the joystick, a centering spring returns it to a neutral position and the autopilot automatically re-engages.

U.S. Pat. No. 6,234,853, which issued to Lanyi et al. on May 22, 2001, discloses a simplified docking method and apparatus for a multiple engine marine vessel. A docking system is provided which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking and maneuvering system uses two marine propulsion units to respond to an operator's command signal and allows the operator to select forward or reverse commands in combination with clockwise or counterclockwise rotational commands either in combination with each other or alone.

International Patent Application WO 03/042036, which was filed by Arvidsson on Nov. 8, 2002, describes a remote control system for a vehicle. It comprises a primary heading sensor fixedly attached to the vehicle, the primary heading sensor being adapted to detect a reference heading, a remote control unit comprising a steering input manipulator, the remote control unit being either portable by a user or rotationally attached to the vehicle relative to a marine axis of the vehicle, the remote control unit being adapted to communicate steering input data to a steering computer programmed to process the steering input data into steering commands and to communicate the steering commands to a steering mechanism of the vehicle. The remote control unit comprises a secondary heading sensor which is synchronized with the primary heading sensor with respect to the reference heading, and the steering input data includes information of an active position of the steering input manipulator relative to the reference heading, the active position of the steering input manipulator determining the desired direction of travel of the vehicle regardless of the orientation of the remote control unit relative to the main axis of the vehicle.

U.S. Pat. No. 6,357,375, which issued to Ellis on Mar. 19, 2002, describes a boat thruster control apparatus. A watercraft is provided with a bow thruster and a stem thruster. A control panel in the helm has a thruster control stick for controlling each thruster and a HOLD device associated with each control stick. When the boat is brought into the desired position, for example, alongside a dock, the HOLD device can be pushed for one or both of the thrusters. When the HOLD is pushed, a signal is sent to a CPU to ignore any changes in position of the corresponding thruster control stick and to maintain the current amount of thrust in the corresponding thruster.

International Patent Application WO 03/093102, which was filed by Arvidsson et al. on Apr. 29, 2003, describes a method of steering a boat with double outboard drives and a boat having double outboard drives. The method of steering a planing V-bottomed boat with double individually steerable outboard drive units with underwater housings, which extend down from the bottom of the boat, is described. When running at planing speed straight ahead, the underwater housings are set with "toe-in" (i.e. inclined toward each other with opposite angles of equal magnitude relative to the boat centerline). When turning, the inner drive unit is set with a greater steering angle than the outer drive unit.

U.S. Pat. No. 6,386,930, which issued to Moffet on May 14, 2002, describes a differential bucket control system for waterjet boats. The boat has a reversing bucket for control forward/reverse thrust and a rotatable nozzle for controlling sideward forces. A bucket position sensor is connected to the reversing bucket, and the bucket is controlled using the output of the position sensor to enable the bucket to be automatically moved to a neutral thrust position. A joystick with two axes of motion may be used to control both the bucket and the nozzle. The joystick has built in centering forces that automatically return it to a neutral position, causing both the bucket and nozzle to return to their neutral positions.

U.S. Pat. No. 6,431,928, which issued to Aarnivuo on Aug. 13, 2002, describes an arrangement and method for turning a propulsion unit. The propeller drive arrangement includes an azimuthing propulsion unit, a power supply, a control unit, and a sensor means. An operating means is provided for turning the azimuthing propulsion unit in relation to the hull of the vessel for steering the vessel in accordance with a steering command controlled by the vessel's steering control device. The operating means also includes a second electric motor for turning the azimuthing propulsion unit via a mechanical power transmission that is connected to the second electric motor.

U.S. Pat. No. 6,447,349, which issued to Fadeley et al. on Sep. 10, 2002, describes a stick control system for a waterjet boat. The boat has a reversing bucket for controlling forward/reverse thrust and a rotatable nozzle for controlling sideward forces. A bucket position sensor is connected to the reversing bucket, and the bucket is controlled using the output of the position sensor to enable the bucket to be automatically moved to a neutral thrust position. Similarly, a nozzle position sensor is connected to the nozzle, and the nozzle is controlled using the output of the nozzle position sensor so that the nozzle may be automatically returned to a zero sideward force position.

U.S. Pat. No. 6,511,354, which issued to Gonring et al. on Jan. 28, 2003, discloses a multipurpose control mechanism for a marine vessel. The mechanism allows the operator of a marine vessel to use the mechanism as both a standard throttle and gear selection device and, alternatively, as a multi-axis joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

U.S. Pat. No. 6,623,320, which issued to Hedlund on Sep. 23, 2003, describes a drive means in a boat. A boat propeller drive with an underwater housing which is connected in a fixed manner to a boat hull and has tractor propellers arranged on that side of the housing facing ahead is described. Arranged in that end portion of the underwater housing facing astern is an exhaust discharge outlet for discharging exhaust gases from an internal combustion engine connected to the propeller drive.

U.S. patent application Ser. No. 10/181,215, which was filed by Varis on Jan. 26, 2001, describes a motor unit for a ship. The invention relates to a propulsion unit arrangement for a ship and includes a motor unit comprising a motor housing which is arranged in the water and which comprises a motor and any control means relating thereto, as well as a propeller which is arranged at a motor shaft. The motor unit comprises an electric motor for which the cooling is arranged to take place via the surface of the motor's whole circumference through the motor's casing structure directing into the water which surrounds the unit.

U.S. Pat. No. 6,705,907, which issued to Hedlund on Mar. 16, 2004, describes a drive means in a boat. A boat propeller drive has an underwater housing which is connected in a fixed manner to a boat hull and has tractor propellers arranged on that side of the housing facing ahead. In the rear edge of the underwater housing, a rudder blade is mounted for pivoting about a vertical rudder axis.

U.S. Pat. No. 6,712,654, which issued to Putaansuu on Mar. 30, 2004, describes a turning of a propulsion unit. The arrangement for moving and steering a vessel includes a propulsion unit having a chamber positioned outside the vessel equipment for rotating a propeller arranged in connection with the chamber, and a shaft means connected to the chamber for supporting the chamber in a rotatable manner at the hull of the vessel. At least one hydraulic motor is used for turning the shaft means in relation to the hull of the vessel for steering the vessel. The arrangement also includes means for altering the rotational displacement of the hydraulic engine.

U.S. Pat. No. 6,783,410, which issued to Florander et al. on Aug. 31, 2004, describes a drive means in a boat which has an underwater housing which is solidly joined to a boat hull and has pulling propellers on the forward facing side of the housing. At the aft edge of the underwater housing, a rudder is mounted, comprising a first rudder blade mounted in the underwater housing and a second rudder blade mounted on the aft edge of the first rudder blade.

U.S. patent application Ser. No. 10/831,962, which was filed by McKenney et al. on Apr. 26, 2004, describes an autopilot-based steering and maneuvering system for boats.

The steering system uses a specially integrated autopilot that remains engaged unless the operator is actively commanding the boat to change course. For example, in a boat in which steering is performed using a joystick, course changes can be effected simply by moving the joystick.

U.S. Pat. No. 6,942,531, which issued to Fell et al. on Sep. 13, 2005, describes a joystick control system for a modified steering system for small boat outboard motors. A joystick controller for modified steering systems for boats with outboard motors is described. The system uses a directional nozzle for the jet output that is attached to a control cable system. This cable turns the directional nozzle, which causes the thrust of the jet output to turn the boat. Thus, the boat can be steered without having to turn the entire motor. The system also has a reversing cup to change direction. The system uses a joystick that connects to a set of actuators, which in turn, connect to the directional nozzle, reverse cup and throttle. In this way the joystick can control the movement of the boat in any direction. The joystick can be used with a conventional motor as well.

U.S. Pat. No. 6,952,180, which issued to Jonsson et al. on Oct. 4, 2005, describes a method and apparatus for determination of position. It is based on a selection and storing of a current position as a waypoint if the following criteria are fulfilled: the current distance of the position along the road from the previous waypoint is greater than a first parameter X or the distance of the position along the road from the previous waypoint is greater than a second parameter Y, where Y is less than X and the deviation between the current traveling direction of the object and the direction established by the connection of the last two waypoints is greater than a third parameter Z and the speed of the object is greater than a minimum speed S. The stored waypoints allow a determination of the traveling direction which is advantageous for localization of vehicles driving on parallel one-way lanes.

The patents described above are hereby expressly incorporated by reference in the description of the present invention.

A presentation, titled "Compact Azipod Propulsion on DP Supply Vessels", was given by Strand et al. at the Thrusters Session of the Dynamic Positioning Conference held in Oslo, Norway on Sep. 18-19, 2001. At that presentation, ABB Marine introduced a product called the Compact Azipod in the offshore supply vessel market on a series of three multifunctional platform supply/ROV vessels. High efficiency, improved maneuverability and station keeping capability, reliability and overall cost effectiveness have been the key criteria for the solutions and overall system design.

A presentation, titled "New Thruster Concept for Station Keeping and Electric Propulsion", was delivered at the Drives Session of the Dynamic Positioning Conference held at Helsinki, Finland on Sep. 18-19, 2001. The presenters were Adnanes et al. After ten years and 300,000 operation hours of experience with Azipod for propulsion and dynamic positioning, the Compact Azipod has been developed to meet market demand for podded thruster units in the power range of 0.4 to 5 MW. High reliability, power efficiency, and life cycle cost efficiency has been the target for this new thruster concept for station keeping and propulsion.

A presentation, titled "Dynamically Positioned and Thruster Assisted Positioned Moored Vessels", was provided by Professor Asgeir J. Sorensen of the Department of Marine Technology at the Norwegian University of Science and Technology in Trondheim, Norway. In that presentation, various applications of dynamically positioned vessels are described. In addition, several different control systems are illustrated in relation to the use of Azipod propulsion devices.

SUMMARY OF THE INVENTION

A method for maneuvering a marine vessel, in accordance with a preferred embodiment of the present invention, comprises the steps of providing a first marine propulsion device which is rotatable about a first steering axis that extends through a lower surface of a hull of a marine vessel, providing a second marine propulsion device which is rotatable about a second steering axis which extends through the lower surface of the hull of the marine vessel, providing a manually operable control device which is configured to provide an output signal which is representative of a desired movement of the marine vessel, resolving the desired movement of the marine vessel into a target linear thrust and a target moment about a preselected point of the marine vessel, and determining a first rotational position of the first marine propulsion device, a second rotational position about the second marine propulsion device, a first magnitude and direction of thrust for the first marine propulsion device, and a second magnitude and direction of thrust for the second marine propulsion device which will result in achievement of the target linear thrust and target moment about the preselected point of the marine vessel. A preferred embodiment of the present invention further comprises the steps of rotating the first and second marine propulsion devices to the first and second rotational positions about the first and second steering axes, respectively, and causing the first and second marine propulsion devices to produce the first and second magnitudes of directions of thrusts, respectively.

The first and second rotational positions result in the first and second marine propulsion devices producing first and second thrust vectors which intersect at a point located on a centerline which extends from a bow to a stem of the marine vessel. The first and second thrust vectors intersect at a center of gravity of the marine vessel when the target moment is equal to zero. The first and second thrust vectors intersect at a point on the centerline other than the center of gravity of the marine vessel when the target moment has an absolute value greater than zero in either the clockwise or counterclockwise directions.

In a particularly preferred embodiment of the present invention, the manually operable control device is a joystick. The first marine propulsion device is located on a port side of the centerline of the marine vessel and the second marine propulsion device is located on a starboard side of the centerline. The first marine propulsion device comprises a first propeller attached to a rear portion of the first marine propulsion device to provide a pushing thrust on the first marine propulsion device when the first propeller is rotated in a forward direction. The second marine propulsion device comprises a second propeller attached to a rear portion of the second marine propulsion device to provide a pushing thrust on the second marine propulsion device when the second propeller is rotated in a forward direction. In a particularly preferred embodiment of the present invention, the first and second steering axes are generally parallel to each other. The first and second rotational positions of the first and second marine propulsion devices are symmetrical about the centerline of the marine vessel. As a result, the steering angle, between the thrust vectors of the first and second marine propulsion devices and the centerline of the marine vessel, are equal in absolute magnitude but opposite in direction.

A method for maintaining a marine vessel in a selected position, according to a preferred embodiment of the present invention, comprises the steps of providing first and second marine propulsion devices which are rotatable about first and second steering axes, respectively, which extend through a lower surface of a hull of the marine vessel. The method also comprises the steps of determining a global position of the marine vessel and a heading of the marine vessel. The method further comprises the step of receiving a signal command to maintain the current global position and heading of the marine vessel and storing the current global position and heading as a target global position and a target heading in response to receiving the signal command. In a particularly preferred embodiment of the present invention, the signal command comprises both an enabling command and an absence of other manually provided positioning or maneuvering commands relating to the marine vessel.

A preferred embodiment of the present invention can further comprise the steps of determining a subsequent global position and subsequent heading of the marine vessel. It also comprises the steps of calculating a position error or difference between the subsequent global position and the target global position and calculating a heading error or difference between the subsequent heading and the target heading. The preferred embodiment of the present invention further comprises the steps of determining the required marine vessel movements to minimize the position error difference and the heading error difference and then resolving the required marine vessel movements into a target linear thrust and a target moment about a preselected point of the marine vessel.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 2:
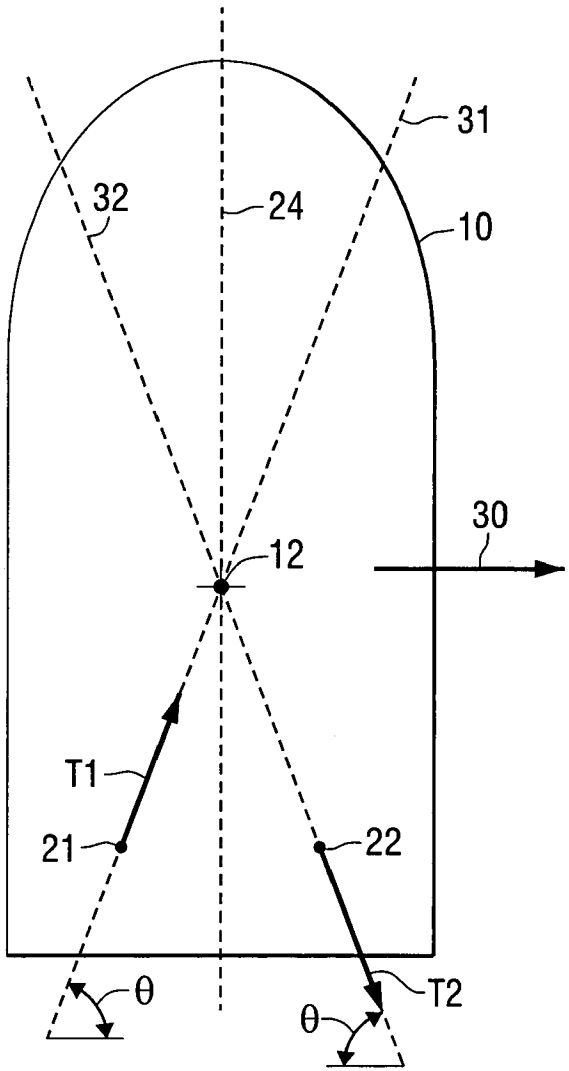
FIGS. 2 and 3 illustrate the arrangement of thrust vectors during a sidle movement of the marine vessel.

Throughout the description of the preferred embodiment of the present invention, like components will be identified by like reference numerals.

Figure 1:
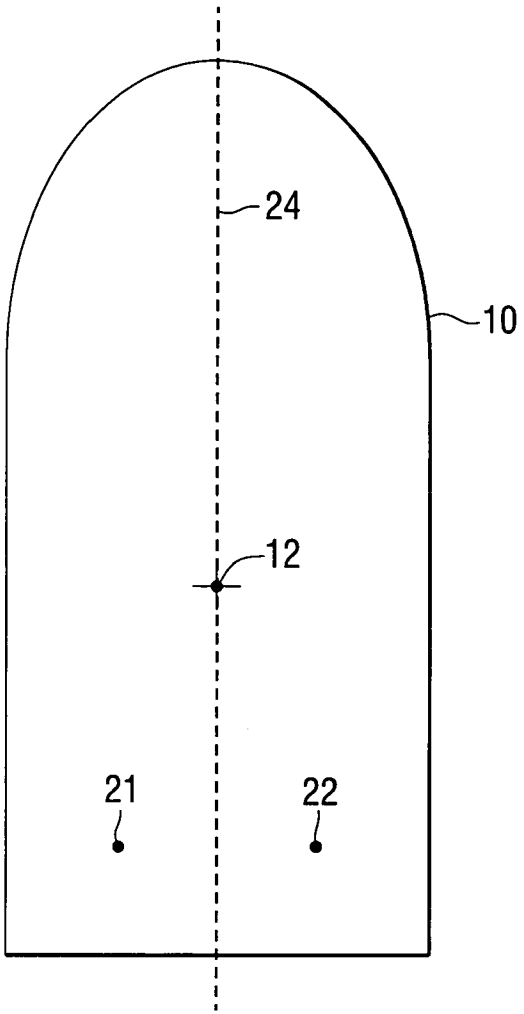
FIG. 1 is a highly schematic representation of a marine vessel showing the steering axes and center of gravity.

In FIG. 1, a marine vessel 10 is illustrated schematically with its center of gravity 12. First and second steering axes, 21 and 22, are illustrated to represent the location of first and second marine propulsion devices (reference numerals 27 and 28 in FIG. 9) located under the hull of the marine vessel 10. The first and second marine propulsion devices are rotatable about the first and second steering axes, 21 and 22, respectively. The first marine propulsion device, on the port side of a centerline 24, is configured to be rotatable 45 degrees in a clockwise direction, viewed from above the marine vessel 10, and 15 degrees in a counterclockwise direction. The second marine propulsion device, located on the starboard side of the centerline 24, is oppositely configured to rotate 15 degrees in a clockwise direction and 45 degrees in a counterclockwise direction. The ranges of rotation of the first and second marine propulsion devices are therefore symmetrical about the centerline 24 in a preferred embodiment of the present invention.

The positioning method of the present invention rotates the first and second propulsion devices about their respective steering axes, 21 and 22, in an efficient manner that allows rapid and accurate maneuvering of the marine vessel 10. This efficient maneuvering of the first and second marine propulsion devices is particularly beneficial when the operator of the marine vessel 10 is docking the marine vessel or attempting to maneuver it in areas where obstacles exist, such as within a marina.

FIG. 2 illustrates one element of the present invention that is used when it is desired to move the marine vessel 10 in a direction represented by arrow 30. In other words, it represents the situation when the operator of the marine vessel wishes to cause it to sidle to the right with no movement in either a forward or reverse direction and no rotation about its center of gravity 12. This is done by rotating the first and second marine propulsion devices so that their thrust vectors, T1 and T2, are both aligned with the center of gravity 12. This provides no effective moment arm about the center of gravity 12 for the thrust vectors, T1 and T2, to exert a force that could otherwise cause the marine vessel 10 to rotate. As can be seen in FIG. 2, the first and second thrust vectors, T1 and T2, are in opposite directions and are equal in magnitude to each other. This creates no resultant forward or reverse force on the marine vessel 10. The first and second thrust vectors are directed along lines 31 and 32, respectively, which intersect at the center of gravity 12. As illustrated in FIG. 2, these two lines, 31 and 32, are positioned at angles θ. As such, the first and second marine propulsion devices are rotated symmetrically relative to the centerline 24. As will be described in greater detail below, the first and second thrust vectors, T1 and T2, can be resolved into components, parallel to centerline 24, that are calculated as a function of the sine of angle θ. These thrust components in a direction parallel to centerline 24 effectively cancel each other if the thrust vectors, T1 and T2, are equal to each other since the absolute magnitudes of the angles θ are equal to each other. Movement in the direction represented by arrow 30 results from the components of the first and second thrust vectors, T1 and T2, being resolved in a direction parallel to arrow 30 (i.e. perpendicular to centerline 24) as a function of the cosine of angle θ. These two resultant thrust components which are parallel to arrow 30 are additive. As described above, the moment about the center of gravity 12 is equal to zero because both thrust vectors, T1 and T2, pass through the center of gravity 12 and, as a result, have no moment arms about that point.

While it is recognized that many other positions of the thrust, T1 and T2, can result in the desired sidling represented by arrow 30, the direction of the thrust vectors in line with the center of gravity 12 of the marine vessel 10 is most effective and is easy to implement. It also minimizes the overall movement of the propulsion devices during complicated maneuvering of the marine vessel 10. Its effectiveness results from the fact that the magnitudes of the first and second thrusts need not be perfectly balanced in order to avoid the undesirable rotation of the marine vessel 10 about its center of gravity 12. Although a general balancing of the magnitudes of the first and second thrusts is necessary to avoid the undesirable forward or reverse movement, no rotation about the center of gravity 12 will occur as long as the thrusts are directed along lines, 31 and 32, which intersect at the center of gravity 12 as illustrated in FIG. 2.

Figure 3:
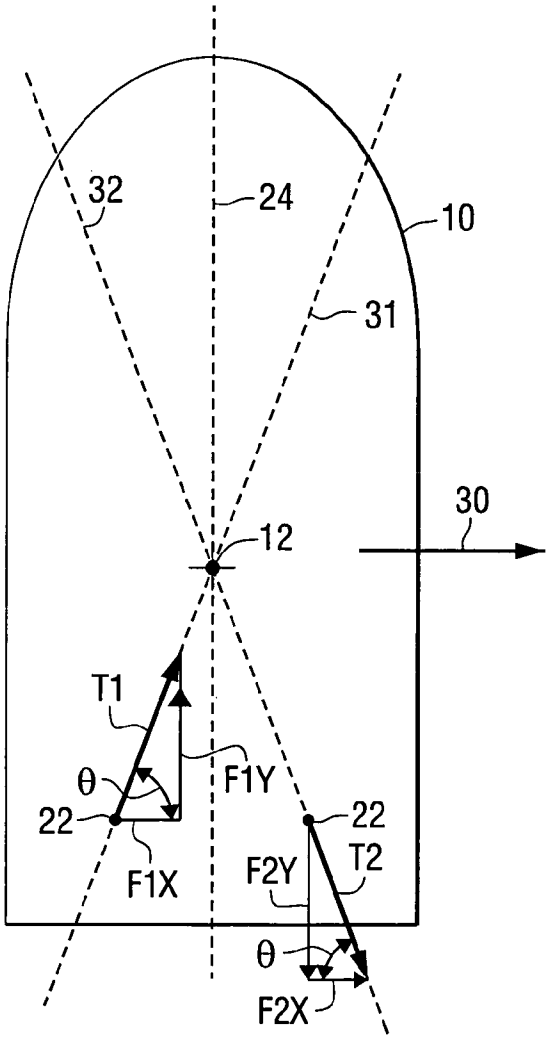

FIG. 3 shows the first and second thrust vectors, T1 and T2, and the resultant forces of those two thrust vectors. For example, the first thrust vector can be resolved into a forward directed force F1Y and a side directed force F1X as shown in FIG. 3 by multiplying the first thrust vector T1 by the sine of θ and the cosine of θ, respectively. Similarly, the second thrust vector T2 is shown resolved into a rearward directed force F2Y and a side directed force F2X by multiplying the second thrust vector T2 by the sine of θ and cosine of θ, respectively. Since the forward force F1Y and rearward force F2Y are equal to each other, they cancel and no resulting forward or reverse force is exerted on the marine vessel 10. The side directed forces, F1X and F2X, on the other hand, are additive and result in the sidle movement represented by arrow 30. Because the lines, 31 and 32, intersect at the center of gravity 12 of the marine vessel 10, no resulting moment is exerted on the marine vessel. As a result, the only movement of the marine vessel 10 is the sidle movement represented by arrow 30.

Figure 4:
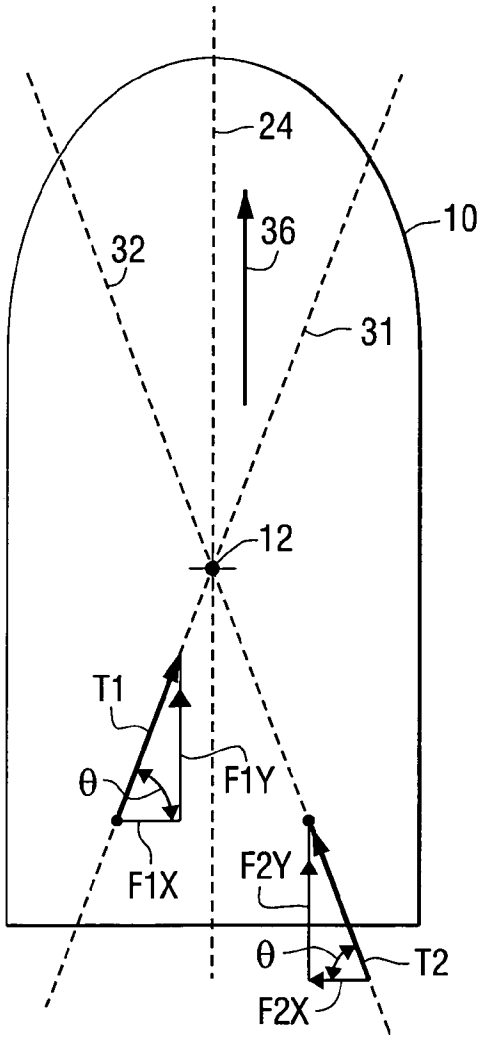
FIG. 4 shows the arrangement of thrust vectors for a forward movement.

FIG. 4 shows the result when the operator of the marine vessel 10 wishes to move in a forward direction, with no side movement and no rotation about the center of gravity 12. The first and second thrusts, T1 and T2, are directed along their respective lines, 31 and 32, and they intersect at the center of gravity 12. Both thrusts, T1 and T2, are exerted in a generally forward direction along those lines. As a result, these thrusts resolve into the forces illustrated in FIG. 4. Side directed forces F1X and F2X are equal to each other and in opposite directions. Therefore, they cancel each other and no sidle force is exerted on the marine vessel 10. Forces F1Y and F2Y, on the other hand, are both directed in a forward direction and result in the movement represented by arrow 36. The configuration of the first and second marine propulsion systems represented in FIG. 4 result in no side directed movement of the marine vessel 10 or rotation about its center of gravity 12. Only a forward movement 36 occurs.

When it is desired that the marine vessel 10 be subjected to a moment to cause it to rotate about its center of gravity 12, the application of the concepts of the present invention depend on whether or not it is also desired that the marine vessel 10 be subjected to a linear force in either the forward/reverse or the left/right direction or a combination of both. When the operator wants to cause a combined movement, with both a linear force and a moment exerted on the marine vessel, the thrust vectors, T1 and T2, are caused to intersect at the point 38 as represented by dashed lines 31 and 32 in FIG. 6. If, on the other hand, the operator of the marine vessel wishes to cause it to rotate about its center of gravity 10 with no linear movement in either a forward/reverse or a left/right direction, the thrust vectors, T1' and T2', are aligned in parallel association with each other and the magnitude of the first and second thrust vectors are directed in opposite directions as represented by dashed arrows T1' and T2' in FIG. 6. When the first and second thrust vectors, T1' and T2', are aligned in this way, the angle θ for both vectors is equal to 90 degrees and their alignment is symmetrical with respect to the centerline 24, but with oppositely directed thrust magnitudes.

Figure 5:
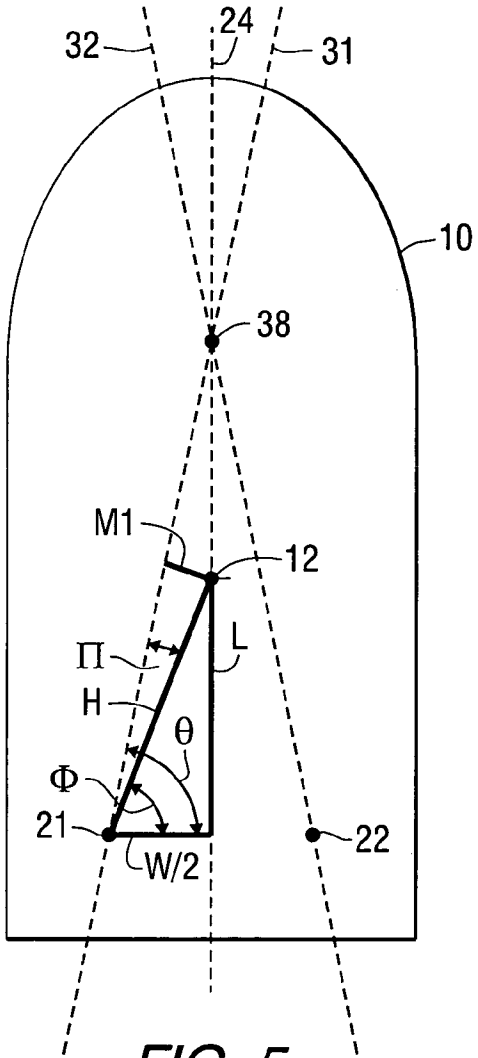
FIG. 5 illustrates the geometry associated with the calculation of a moment arm relative to the center of gravity of a marine vessel.

When a rotation of the marine vessel 10 is desired in combination with linear movement, the first and second marine propulsion devices are rotated so that their thrust vectors intersect at a point on the centerline 24 other than the center of gravity 12 of the marine vessel 10. This is illustrated in FIG. 5. Although the thrust vectors, T1 and T2, are not shown in FIG. 5, their associated lines, 31 and 32, are shown intersecting at a point 38 which is not coincident with the center of gravity 12. As a result, an effective moment arm MI exists with respect to the first marine propulsion device which is rotated about its first steering axis 21. Moment arm M1 is perpendicular to dashed line 31 along which the first thrust vector is aligned. As such, it is one side of a right triangle which also comprises a hypotenuse H. It should also be understood that another right triangle in FIG. 5 comprises sides L, W/2, and the hypotenuse H. Although not shown in FIG. 5, for purposes of clarity, a moment arm M2 of equal magnitude to moment arm M1 would exist with respect to the second thrust vector directed along line 32. Because of the intersecting nature of the thrust vectors, they each resolve into components in both the forward/reverse and left/right directions. The components, if equal in absolute magnitude to each other, may either cancel each other or be additive. If unequal in absolute magnitude, they may partially offset each other or be additive. However, a resultant force will exist in some linear direction when the first and second thrust vectors intersect at a point 38 on the centerline 24.

With continued reference to FIG. 5, those skilled in the art recognize that the length of the moment arm M1 can be determined as a function of angle θ, angle Φ, angle Π, the distance between the first and second steering axes, 21 and 22, which is equal to W in FIG. 5, and the perpendicular distance between the center of gravity 12 and a line extending between the first and second steering axes. This perpendicular distance is identified as L in FIG. 5. The length of the line extending between the first steering axis 21 and the center of gravity 12 is the hypotenuse of the triangle shown in FIG. 5 and can easily be determined. The magnitude of angle Φ is equivalent to the arctangent of the ratio of length L to the distance between the first steering axis 21 and the centerline 24, which is identified as W/2 in FIG. 5. Since the length of line H is known and the magnitude of angle H is known, the length of the moment arm M1 can be mathematically determined.

Figure 6:
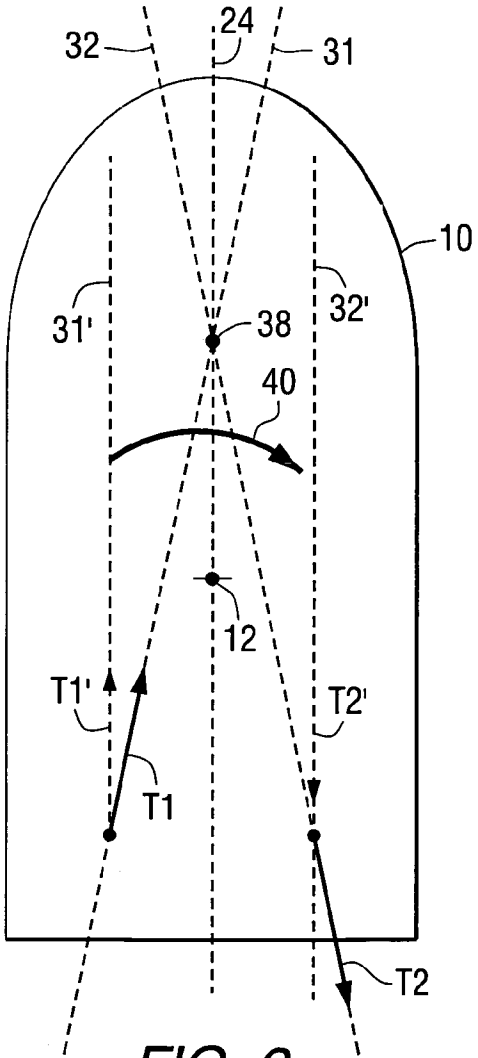
FIG. 6 shows the arrangement of thrust vectors used to rotate the marine vessel about its center of gravity.

As described above, a moment, represented by arrow 40 in FIG. 6, can be imposed on the marine vessel 10 to cause it to rotate about its center of gravity 12. The moment can be imposed in either rotational direction. In addition, the rotating force resulting from the moment 40 can be applied either in combination with a linear force on the marine vessel or alone. In order to combine the moment 40 with a linear force, the first and second thrust vectors, T1 and T2, are positioned to intersect at the point 38 illustrated in FIG. 6. The first and second thrust vectors, T1 and T2, are aligned with their respective dashed lines, 31 and 32, to intersect at this point 38 on the centerline 24 of the marine vessel. If, on the other hand, it is desired that the moment 40 be the only force on the marine vessel 10, with no linear forces, the first and second thrust vectors, represented by T1' and T2' in FIG. 6, are aligned in parallel association with each other. This, effectively, causes angle θ to be equal to 90 degrees. If the first and second thrust vectors, T1' and T2', are then applied with equal magnitudes and in opposite directions, the marine vessel 10 will be subjected only to the moment 40 and to no linear forces. This will cause the marine vessel 10 to rotate about its center of gravity 12 while not moving in either the forward/reverse or the left/right directions.

In FIG. 6, the first and second thrust vectors, T1 and T2, are directed in generally opposite directions and aligned to intersect at the point 38 which is not coincident with the center of gravity 12. Although the construction lines are not shown in FIG. 6, effective moment arms, M1 and M2, exist with respect to the first and second thrust vectors and the center of gravity 12. Therefore, a moment is exerted on the marine vessel 10 as represented by arrow 40. If the thrust vectors T1 and T2 are equal to each other and are exerted along lines 31 and 32, respectively, and these are symmetrical about the centerline 24 and in opposite directions, the net component forces parallel to the centerline 24 are equal to each other and therefore no net linear force is exerted on the marine vessel 10 in the forward/reverse directions. However, the first and second thrust vectors, T1 and T2, also resolve into forces perpendicular to the centerline 24 which are additive. As a result, the marine vessel 10 in FIG. 6 will move toward the right as it rotates in a clockwise direction in response to the moment 40.

In order to obtain a rotation of the marine vessel 10 with no lateral movement in the forward/reverse or left/right directions, the first and second thrust vectors, represented as T1' and T2' in FIG. 6, are directed along dashed lines, 31' and 32', which are parallel to the centerline 24. The first and second thrust vectors, T1' and T2', are of equal and opposite magnitude. As a result, no net force is exerted on the marine vessel 10 in a forward/reverse direction. Since angle θ, with respect to thrust vectors T1' and T2', is equal to 90 degrees, no resultant force is exerted on the marine vessel 10 in a direction perpendicular to the centerline 24. As a result, a rotation of the marine vessel 10 about its center of gravity 12 is achieved with no linear movement.

Figure 7:
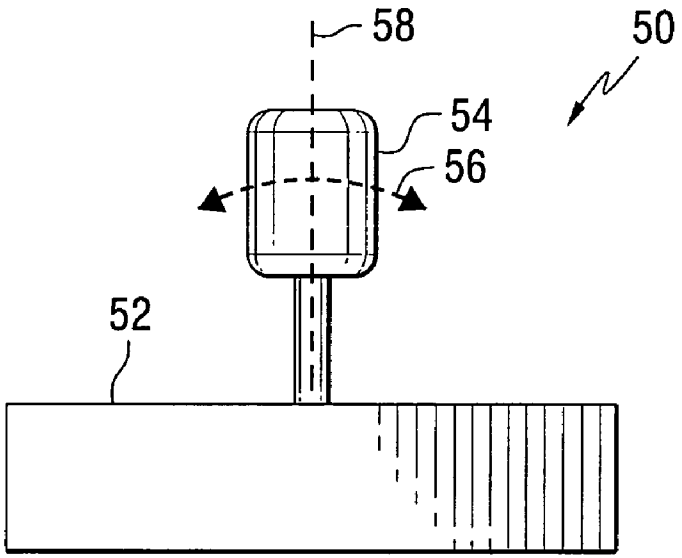

FIG. 7 is a simplified schematic representation of a joystick 50 which provides a manually operable control device which can be used to provide a signal that is representative of a desired movement, selected by an operator, relating to the marine vessel. Many different types of joysticks are known to those skilled in the art. The schematic representation in FIG. 7 shows a base portion 52 and a handle 54 which can be manipulated by hand. In a typical application, the handle is movable in the direction generally represented by arrow 56 and is also rotatable about an axis 58. It should be understood that the joystick handle 54 is movable, by tilting it about its connection point in the base portion 52 in virtually any direction. Although dashed line 56 is illustrated in the plane of the drawing in FIG. 7, a similar type movement is possible in other directions that are not parallel to the plane of the drawing.

Figure 8:
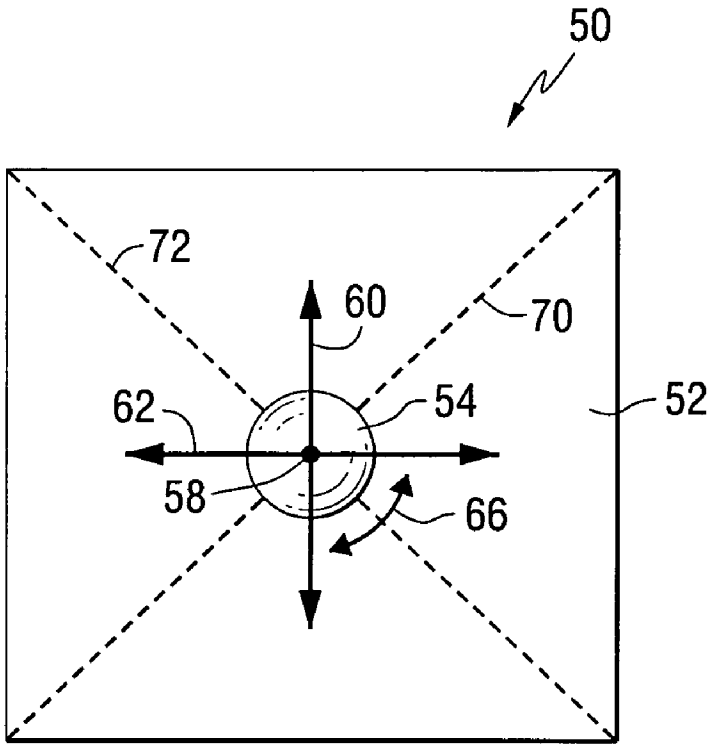
FIGS. 7 and 8 are two schematic representation of a joystick used in conjunction with the present invention.

FIG. 8 is a top view of the joystick 50. The handle 54 can move, as indicated by arrow 56 in FIG. 7, in various directions which include those represented by arrows 60 and 62. However, it should be understood that the handle 54 can move in any direction relative to axis 58 and is not limited to the two lines of movement represented by arrows 60 and 62. In fact, the movement of the handle 54 has a virtually infinite number of possible paths as it is tilted about its connection point within the base 52. The handle 54 is also rotatable about axis 58, as represented by arrow 66. Those skilled in the art are familiar with many different types of joystick devices that can be used to provide a signal that is representative of a desired movement of the marine vessel, as expressed by the operator of the marine vessel through movement of the handle 54.

With continued reference to FIG. 8, it can be seen that the operator can demand a purely linear movement either toward port or starboard, as represented by arrow 62, a purely linear movement in a forward or reverse direction as represented by arrow 60, or any combination of the two. In other words, by moving the handle 54 along dashed line 70, a linear movement toward the right side and forward or toward the left side and rearward can be commanded. Similarly, a linear movement along lines 72 could be commanded. Also, it should be understood that the operator of the marine vessel can request a combination of sideways or forward/reverse linear movement in combination with a rotation as represented by arrow 66. Any of these possibilities can be accomplished through use of the joystick 50. 5 The magnitude, or intensity, of movement represented by the position of the handle 54 is also provided as an output from the joystick. In other words, if the handle 54 is moved slightly toward one side or the other, the commanded thrust in that direction is less than if, alternatively, the handle 54 was moved by a greater magnitude away from its vertical position with respect to the base 52. Furthermore, rotation of the handle 54 about axis 58, as represented by arrow 66, provides a signal representing the intensity of desired movement. A slight rotation of the handle about axis 58 would represent a command for a slight rotational thrust about the center of gravity 12 of the marine vessel 10. On the other hand, a more intense rotation of the handle 54 about its axis would represent a command for a higher magnitude of rotational thrust.

With reference to FIGS. 1-8, it can be seen that movement of the joystick handle 54 can be used by the operator of the marine vessel 10 to represent virtually any type of desired movement of the vessel. In response to receiving a signal from the joystick 50, an algorithm, in accordance with a preferred embodiment of the present invention, determines whether or not a rotation 40 about the center of gravity 12 is requested by the operator. If no rotation is requested, the first and second marine propulsion devices are rotated so that their thrust vectors align, as shown in FIGS. 2-4, with the center of gravity 12 and intersect at that point. This results in no moment being exerted on the marine vessel 10 regardless of the magnitudes or directions of the first and second thrust vectors, T1 and T2. The magnitudes and directions of the first and second thrust vectors are then determined mathematically, as described above in conjunction with FIGS. 3 and 4. If, on the other hand, the signal from the joystick 50 indicates that a rotation about the center of gravity 12 is requested, the first and second marine propulsion devices are directed along lines, 31 and 32, that do not intersect at the center of gravity 12. Instead, they intersect at another point 38 along the centerline 24. As shown in FIG. 6, this intersection point 38 can be forward from the center of gravity 12. The thrusts, T1 and T2, shown in FIG. 6 result in a clockwise rotation 40 of the marine vessel 10. Alternatively, if the first and second marine propulsion devices are rotated so that they intersect at a point along the centerline 24 which is behind the center of gravity 12, an opposite effect would be realized. It should also be recognized that, with an intersect point 38 forward from the center of gravity 12, the directions of the first and second thrusts, T1 and T2, could be reversed to cause a rotation of the marine vessel 10 in a counterclockwise direction.

In the various maneuvering steps described in conjunction with FIGS. 1-6, it can be seen that the first and second marine propulsion devices are directed so that they intersect along the centerline 24. That point of intersection can be at the center of gravity 12 or at another point such as point 38. In addition, the lines, 31 and 32, along which the first and second thrust vectors are aligned, are symmetrical in all cases. In other words, the first and second marine propulsion devices are positioned at angles θ relative to a line perpendicular to the centerline 24. The thrust vectors are, however, aligned in opposite directions relative to the centerline 24 so that they are symmetrical to the centerline even though they may be in opposite directions as illustrated in FIG. 6.

While it is recognized that the movements of the marine vessel 10 described above can be accomplished by rotating the marine propulsion devices in an asymmetrical way, contrary to the description of the present invention in relation to FIGS. 1-6, the speed and consistency of movement are enhanced by the consistent alignment of the first and second thrust vectors at points along the centerline 24 and, when no rotation about the center of gravity 12 is required, at the center of gravity itself. This symmetrical movement and positioning of the first and second marine propulsion devices simplifies the necessary calculations to determine the resolved forces and moments and significantly reduces the effects of any errors in the thrust magnitudes.

As described above, in conjunction with FIGS. 1-6, the first and second thrust vectors, T1 and T2, can result from either forward or reverse operation of the propellers of the first and second marine propulsion devices. In other words, with respect to FIG. 6, the first thrust vector T1 would typically be provided by operating the first marine propulsion device in forward gear and the second thrust vector T2 would be achieved by operating the second marine propulsion device in reverse gear. However, as is generally recognized by those skilled in the art, the resulting thrust obtained from a marine propulsion device by operating it in reverse gear is not equal in absolute magnitude to the resulting thrust achieved by operating the propeller in forward gear. This is the result of the shape and hydrodynamic effects caused by rotating the propeller in a reverse direction. However, this effect can be determined and calibrated so that the rotational speed (RPM) of the reversed propeller can be selected in a way that the effective resulting thrust can be accurately predicted. In addition, the distance L between the line connecting the first and second steering axes, 21 and 22, and the center of gravity 12 must be determined for the marine vessel 10 so that the operation of the algorithm of the present invention is accurate and optimized. This determination is relatively easy to accomplish. Initially, a presumed location of the center of gravity 12 is determined from information relating to the structure of the marine vessel 10. With reference to FIG. 3, the first and second marine propulsion devices are then aligned so that their axes, 31 and 32, intersect at the presumed location of the center of gravity 12. Then, the first and second thrusts, T1 and T2, are applied to achieve the expected sidle movement 30. If any rotation of the marine vessel 10 occurs, about the actual center of gravity, the length L (illustrated in FIG. 5) is presumed to be incorrect. That length L in the microprocessor is then changed slightly and the procedure is repeated. When the sidle movement 30 occurs without any rotation about the currently assumed center of gravity, it can be concluded that the currently presumed location of the center of gravity 12 and the magnitude of length L are correct. It should be understood that the centerline 24, in the context of the present invention, is a line which extends through the center of gravity of the marine vessel 10. It need not be perfectly coincident with the keel line of the marine vessel, but it is expected that in most cases it will be.

As mentioned above, propellers do not have the same effectiveness when operated in reverse gear than they do when operated in forward gear for a given rotational speed. Therefore, with reference to FIG. 3, the first thrust T1 would not be perfectly equal to the second thrust T2 if the two propellers systems were operated at identical rotational speeds. In order to determine the relative efficiency of the propellers when they are operated in reverse gear, a relatively simple calibration procedure can be followed. With continued reference to FIG. 3, first and second thrusts, T1 and T2, are provided in the directions shown and aligned with the center of gravity 12. This should produce the sidle movement 30 as illustrated. However, this assumes that the two thrust vectors, T1 and T2, are equal to each other. In a typical calibration procedure, it is initially assumed that the reverse operating propeller providing the second thrust T2 would be approximately 80% as efficient as the forward operating propeller providing the first thrust vector T1. The rotational speeds were selected accordingly, with the second marine propulsion device operating at 125% of the speed of the first marine propulsion device. If a forward or reverse movement is experienced by the marine vessel 10, that initial assumption would be assumed to be incorrect. By slightly modifying the assumed efficiency of the reverse operating propeller, the system can eventually be calibrated so that no forward or reverse movement of the marine vessel 10 occurs under the situation illustrated in FIG. 3. In an actual example, this procedure was used to determine that the operating efficiency of the propellers, when in reverse gear, is approximately 77% of their efficiency when operated in forward gear. Therefore, in order to balance the first and second thrust vectors, T1 and T2, the reverse operating propellers of the second marine propulsion device would be operated at a rotational speed (i.e. RPM) which is approximately 29.87% greater than the rotational speed of the propellers of the first marine propulsion device. Accounting for the inefficiency of the reverse operating propellers, this technique would result in generally equal magnitudes of the first and second thrust vectors, T1 and T2.

Figure 9:
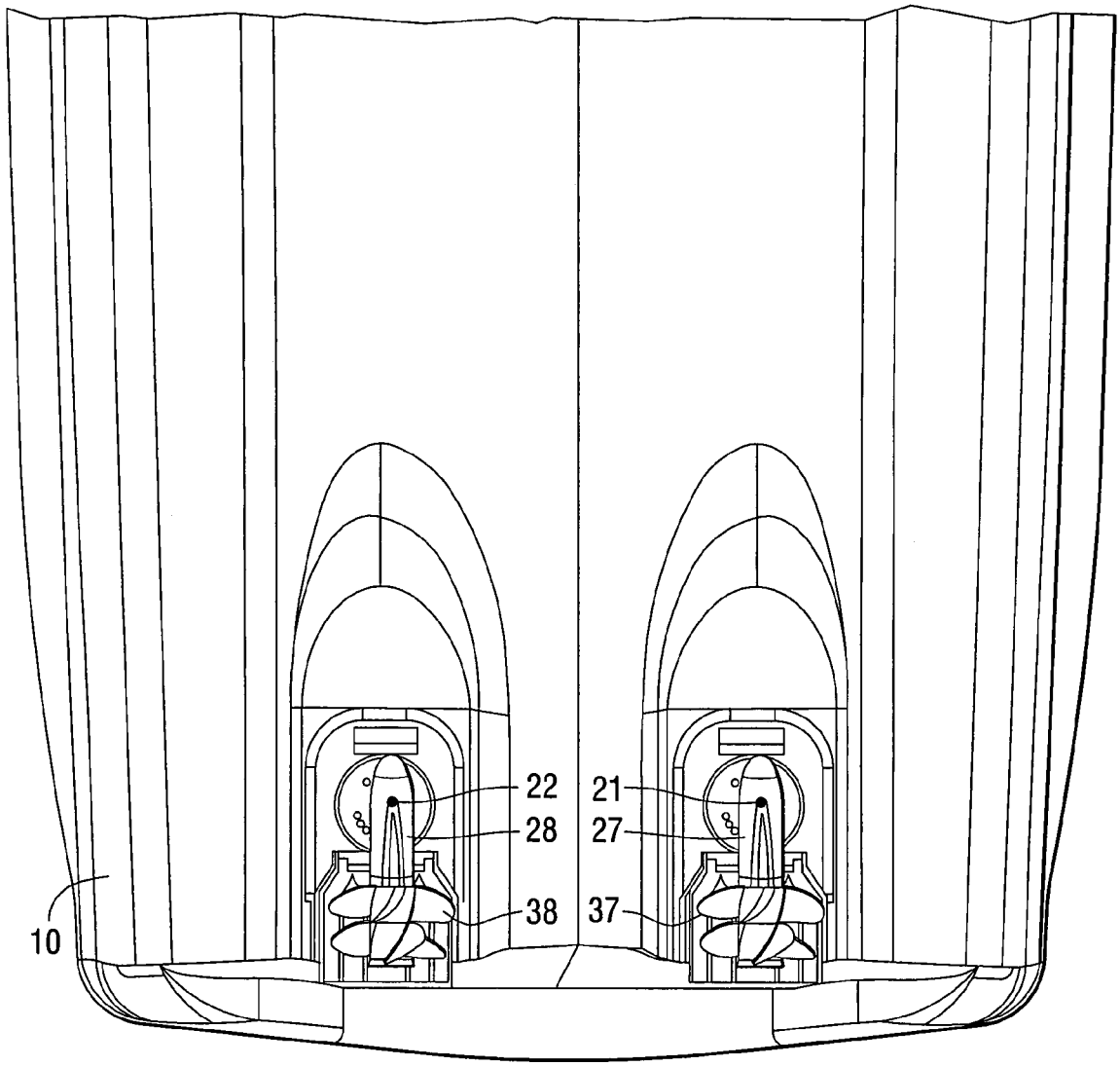
FIG. 9 is a bottom view of the hull of a marine vessel showing the first and second marine propulsion devices extending therethrough.

FIG. 9 is an isometric view of the bottom portion of a hull of a marine vessel 10, showing first and second marine propulsion devices, 27 and 28, and propellers, 37 and 38, respectively. The first and second marine propulsion devices, 27 and 28, are rotatable about generally vertical steering axes, 21 and 22, as described above. In order to avoid interference with portions of the hull of the marine vessel 10, the two marine propulsion devices are provided with limited rotational steering capabilities as described above. Neither the first nor the second marine propulsion device is provided, in a particularly preferred embodiment of the present invention, with the capability of rotating 360 degrees about its respective steering axis, 21 or 22.

Figure 10:
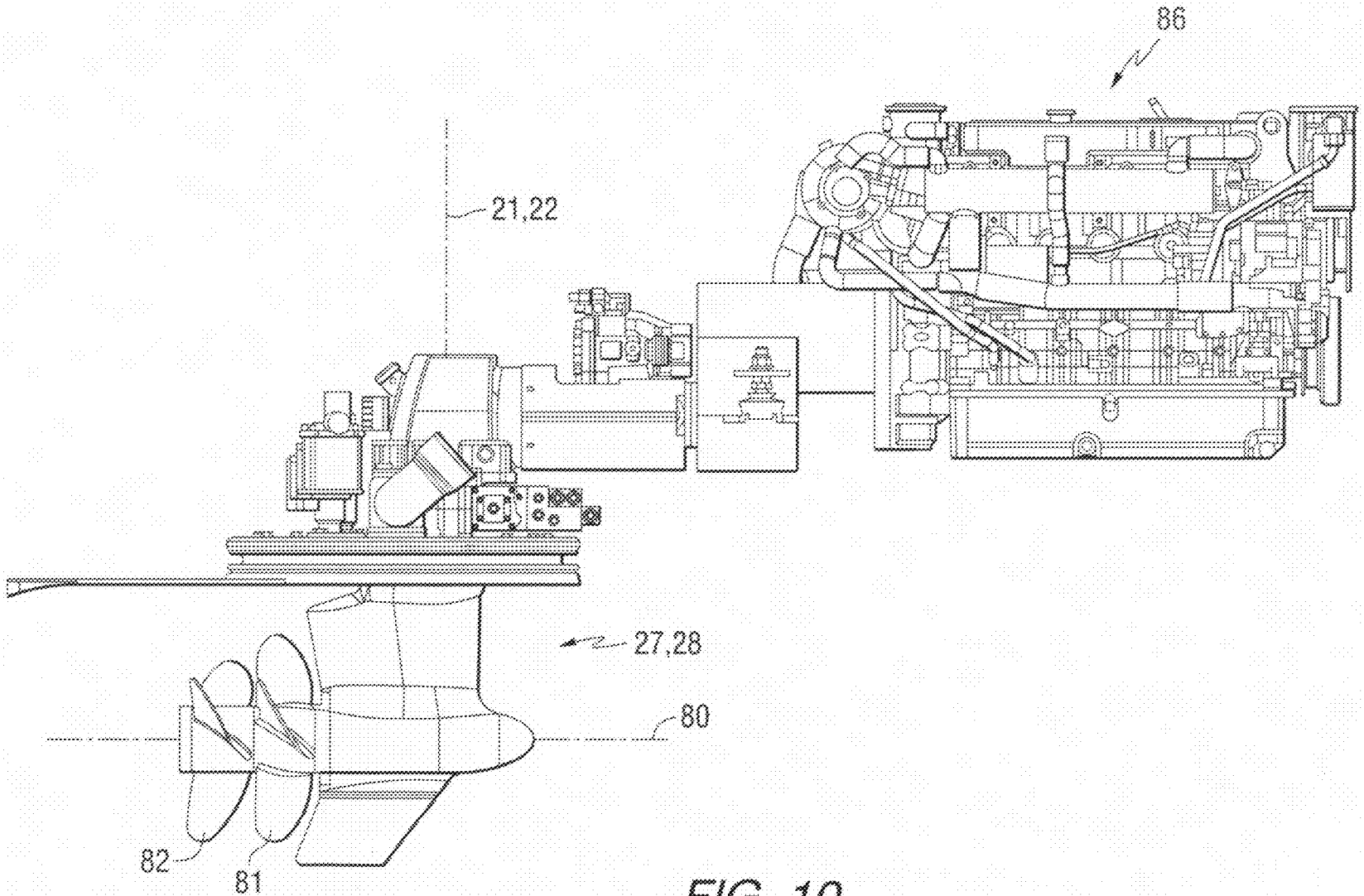
FIG. 10 is a side view showing the arrangement of an engine, steering mechanism, and marine propulsion device used in conjunction with the present invention.

FIG. 10 is a side view showing the arrangement of a marine propulsion device, such as 27 or 28, associated with a mechanism that is able to rotate the marine propulsion device about its steering axis, 21 or 22. Although not visible in FIG. 10, the driveshaft of the marine propulsion device extends vertically and parallel to the steering axis and is connected in torque transmitting relation with a generally horizontal propeller shaft that is rotatable about a propeller axis 80. The embodiment of the present invention shown in FIG. 10 comprises two propellers, 81 and 82, that are attached to the propeller shaft. The motive force to drive the propellers, 81 and 82, is provided by an internal combustion engine 86 that is located within the bilge of the marine vessel 10. It is configured with its crankshaft aligned for rotation about a horizontal axis. In a particularly preferred embodiment of the present invention, the engine 86 is a diesel engine. Each of the two marine propulsion devices, 27 and 28, is driven by a separate engine 86. In addition, each of the marine propulsion devices, 27 and 28, are independently steerable about their respective steering axes, 21 or 22. The steering axes, 21 and 22, are generally vertical and parallel to each other. They are not intentionally configured to be perpendicular to the bottom surface of the hull. Instead, they are generally vertical and intersect the bottom surface of the hull at an angle that is not equal to 90 degrees when the bottom surface of the hull is a V-type hull or any other shape which does not include a flat bottom.

With continued reference to FIG. 10, the submerged portion of the marine propulsion device, 27 or 28, contains rotatable shafts, gears, and bearings which support the shafts and connect the driveshaft to the propeller shaft for rotation of the propellers. No source of motive power is located below the hull surface. The power necessary to rotate the propellers is solely provided by the internal combustion engine.

Figure 11:
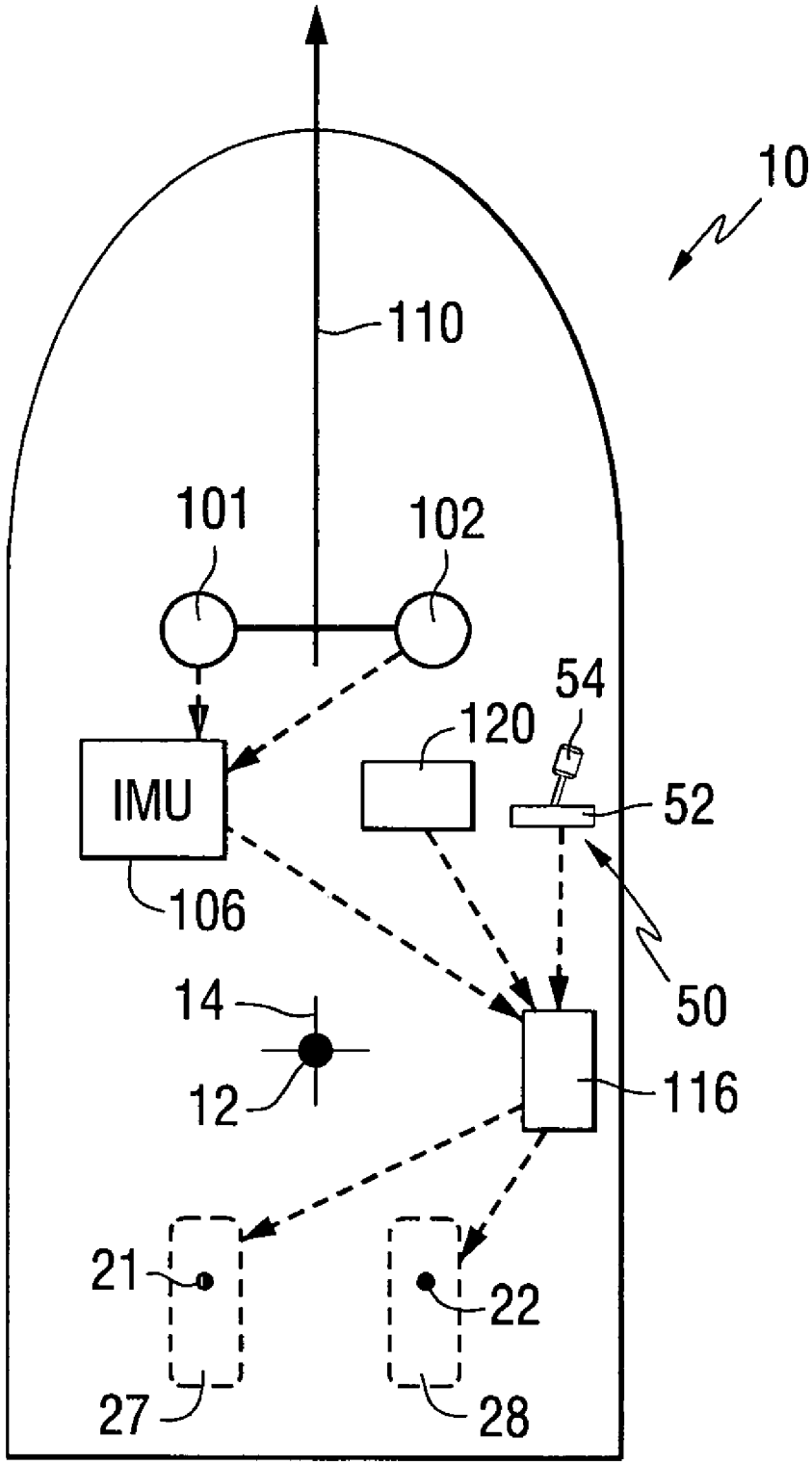
FIG. 11 is a schematic representation of a marine vessel equipped with the devices for performing the station keeping function of the present invention.

FIG. 11 is a schematic representation of a marine vessel 10 which is configured to perform the steps of a preferred embodiment of the present invention relating to a method for maintaining a marine vessel in a selected position. The marine vessel 10 is provided with a global positioning system (GPS) which, in a preferred embodiment of the present invention, comprises a first GPS device 101 and a second GPS device 102 which are each located at a preselected fixed position on the marine vessel 10. Signals from the GPS devices are provided to an inertial measurement unit (IMU) 106. The IMU is identified as model RT3042 and is available in commercial quantities from Oxford Technology. In certain embodiments of the IMU 106, it comprises a differential correction receiver, accelerometers, angular rate sensors, and a microprocessor which manipulates the information obtained from these devices to provide information relating to the current position of the marine vessel 10, in terms of longitude and latitude, the current heading of the marine vessel 10, represented by arrow 110 in FIG. 11, and the velocity and acceleration of the marine vessel 10 in six degrees of freedom.

FIG. 11 also shows a microprocessor 116 which receives inputs from the IMU 106. The microprocessor 116 also receives information from a device 120 which allows the operator of the marine vessel 10 to provide manually selectable modes of operation. As an example, the device 120 can be an input screen that allows the operator of the marine vessel to manually select various modes of operation associated with the marine vessel 10. One of those selections made by the operator of the marine vessel can provide an enabling signal which informs the microprocessor 116 that the operator desires to operate the vessel 10 in a station keeping mode in order to maintain the position of the marine vessel in a selected position. In other words, the operator can use the device 120 to activate the present invention so that the marine vessel 10 is maintained at a selected global position (e.g. a selected longitude and latitude) and a selected heading (e.g. with arrow 110 being maintained at a fixed position relative to a selected compass point).

With continued reference to FIG. 11, a manually operable control device, such as the joystick 50, can also be used to provide a signal to the microprocessor 116. As described above, the joystick 50 can be used to allow the operator of the marine vessel 10 to manually maneuver the marine vessel. It can also provide information to the microprocessor 116 regarding its being in an active status or inactive status. While the operator is manipulating the joystick 50, the joystick is in an active status. However, if the operator releases the joystick 50 and allows the handle 54 to return to its centered and neutral position, the joystick 50 reverts to an inactive status. As will be described in greater detail below, a particularly preferred embodiment of the present invention can use the information relating to the active or inactive status of the joystick 50 in combination with an enabling mode received from the device 120 to allow the operator to select the station keeping mode of the present invention. In this embodiment, the operator can use the joystick 50 to manually maneuver the marine vessel 10 into a particularly preferred position, represented by a global position and a heading, and then release the joystick 50 to immediately and automatically request the present invention to maintain that newly achieved global position and heading. This embodiment of the present invention can be particularly helpful during docking procedures.

As described above, the first and second marine propulsion devices, 27 and 28, are steerable about their respective axes, 21 and 22. Signals provided by the microprocessor 116 allow the first and second marine propulsion devices to be independently rotated about their respective steering axes in order to coordinate the movement of the marine vessel 10 in response to operator commands.

Figure 12:
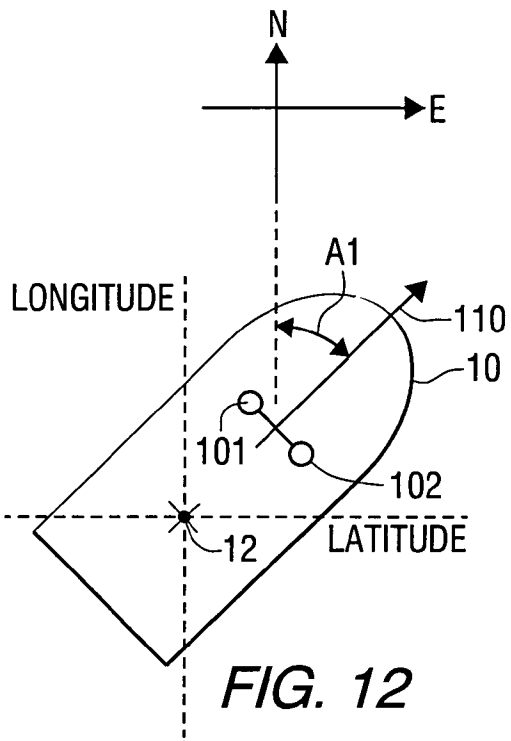
FIG. 12 is a representation of a marine vessel at a particular global position and with a particular heading which are exemplary.

FIG. 12 shows a marine vessel 10 at an exemplary global position, measured as longitude and latitude, and an exemplary heading represented by angle A1 between the heading arrow 110 of the marine vessel 10 and a due north vector. Although alternative position defining techniques can be used in conjunction with the present invention, a preferred embodiment uses both the global position and heading of the vessel 10 for the purpose of determining the current position of the vessel and calculating the necessary position corrections to return the vessel to its position.

As described above, GPS devices, 101 and 102, are used by the IMU 106 to determine the information relating to its position. For purposes of describing a preferred embodiment of the present invention, the position will be described in terms of the position of the center of gravity 12 of the marine vessel and a heading vector 110 which extends through the center of gravity. However, it should be understood that alternative locations on the marine vessel 10 can be used for these purposes. The IMU 106, described above in conjunction with FIG. 11, provides a means by which this location on the marine vessel 10 can be selected.

The station keeping function of the present invention, where it maintains the desired global position and desired heading of the marine vessel, can be activated in several ways. In the simplest embodiment of the present invention, the operator of the marine vessel 10 can actuate a switch that commands the microprocessor 116 to maintain the current position whenever the switch is actuated. In a particularly preferred embodiment of the present invention, the station keeping mode is activated when the operator of the marine vessel enables the station keeping, or position maintaining, function and the joystick 50 is inactive. If the station keeping mode is enabled, but the joystick is being manipulated by the operator of the marine vessel 10, a preferred embodiment of the present invention temporarily deactivates the station keeping mode because of the apparent desire by the operator of the marine vessel to manipulate its position manually. However, as soon as the joystick 50 is released by the operator, this inactivity of the joystick in combination with the enabled station keeping mode causes the preferred embodiment of the present invention to resume its position maintaining function.

Figure 13:
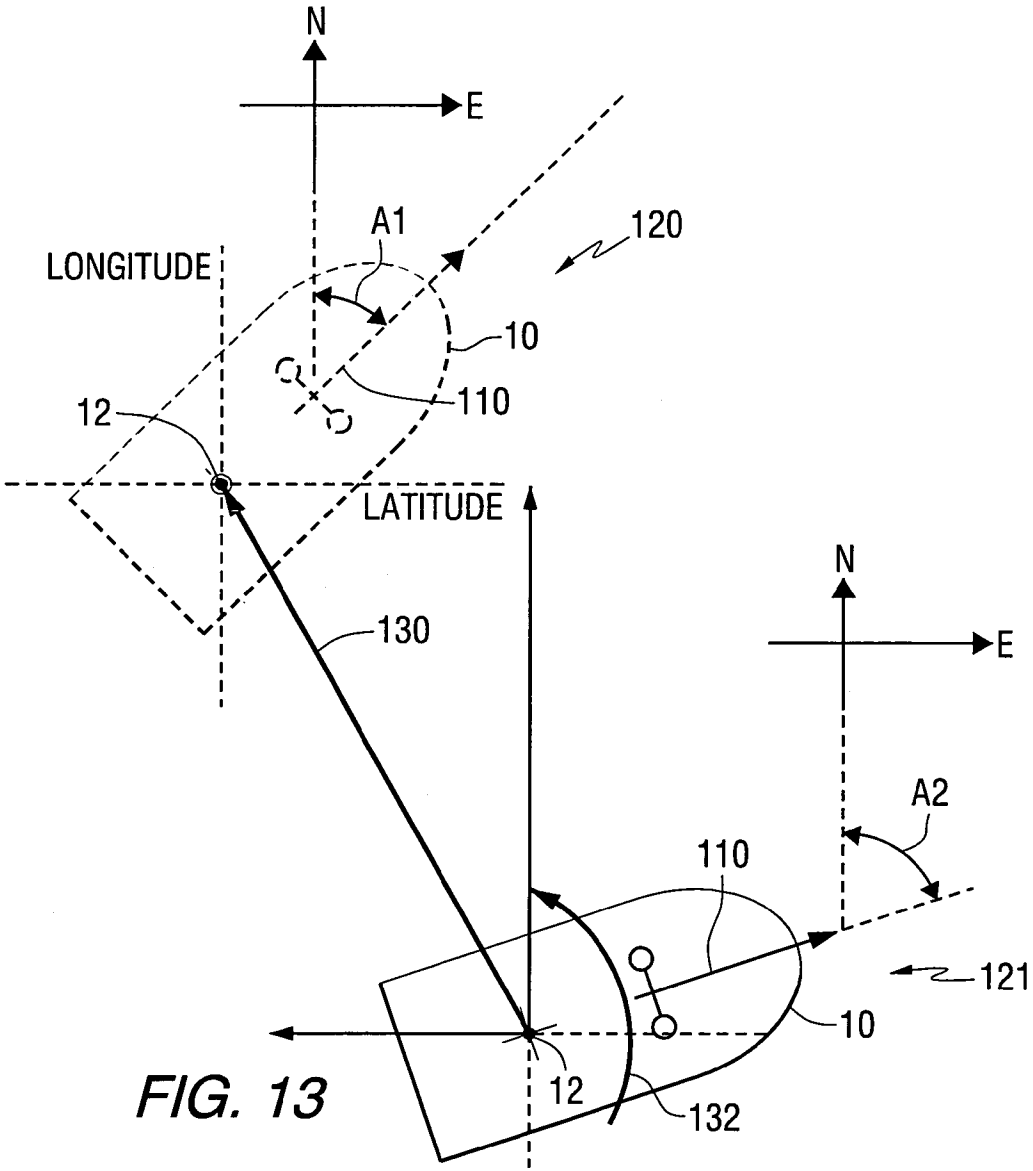
FIG. 13 shows a marine vessel which has moved from an initial position to a subsequent position.

FIG. 13 is a schematic representation that shows the marine vessel 10 in two exemplary positions. An initial, or desired, position 120 is generally identical to that described above in conjunction with FIG. 12. Its initial position is defined by a global position and a heading. The global position is identified by the longitude and latitude of the center of gravity 12 when the vessel 10 was at its initial, or desired, position 120. The heading, represented by angle A1, is associated with the vessel heading when it was at its initial position 120.

Assuming that the vessel 10 moved to a subsequent position 121, the global position of its center of gravity 12 moved to the location represented by the subsequent position 121 of the vessel 10. In addition, the marine vessel 10 is illustrated as having rotated slightly in a clockwise direction so that its heading vector 110 is now defined by a larger angle A2 with respect to a due north vector.

With continued reference to FIG. 13, it should be understood that the difference in position between the initial position 120 and the later position 121 is significantly exaggerated so that the response by the present invention can be more clearly described. A preferred embodiment of the present invention determines a difference between a desired position, such as the initial position 120, and the current position, such as the subsequent position 121 that resulted from the vessel 10 drifting. This drift of the vessel 10 can occur because of wind, tide, or current.

The current global position and heading of the vessel is compared to the previously stored desired global position and heading. An error, or difference, in the north, east and heading framework is computed as the difference between the desired global position and heading and the actual global position and heading. This error, or difference, is then converted to an error, or difference, in the forward, right and heading framework of the vessel which is sometimes referred to as the body framework. These vessel framework error elements are then used by the control strategies that will be described in greater detail below which attempt to simultaneously null the error, or difference, elements. Through the use of a PID controller, a desired force is computed in the forward and right directions, with reference to the marine vessel, along with a desired YAW moment relative to the marine vessel in order to null the error elements. The computed force and moment elements are then transmitted to the vessel maneuvering system described above which delivers the requested forces and moments by positioning the independently steerable marine propulsion drives, controlling the power provided to the propellers of each drive, and controlling the thrust vector directions of both marine propulsion devices.

The difference between the desired position 120 and the current position 121 can be reduced if the marine vessel 10 is subjected to an exemplary target linear thrust 130 and a target moment 132. The target linear thrust 130 and the target moment 132, in a preferred embodiment of the present invention, are achieved by a manipulation of the first and second marine propulsion devices as described above in conjunction with FIGS. 2-6. The target linear thrust 130 will cause the marine vessel 10 to move towards its initial, or desired, position which is measured as a magnitude of longitude and latitude. The target moment 132 will cause the marine vessel 10 to rotate about its center of gravity 12 so that its heading vector 110 moves from the current position 121 to the initial position 120. This reduces the heading angle from the larger magnitude of angle A2 to the smaller magnitude of A1. Both the target linear thrust 130 and target moment 132 are computed to decrease the errors between the current global position and heading at location 121 and the desired global position and heading at the desired position 120.

With continued reference to FIG. 13, it should be recognized that the station keeping mode of the present invention is not always intended to move the marine vessel 10 by significant distances. Instead, its continual response to slight changes in global position and heading will more likely maintain the vessel in position without requiring perceptible movements of the vessel 10. In other words, the first and second marine propulsion devices are selectively activated in response to slight deviations in the global position and heading of the marine vessel and, as a result, large corrective moves such as that which is illustrated in FIG. 13 will not normally be required. As a result, the thrusts provided by the first and second marine propulsion devices continually counter the thrusts on the marine vessel caused by wind, current, and tide so that the net result is an appearance that the marine vessel is remaining stationary and is unaffected by the external forces. However, alternative embodiments of the present invention could be used to cause the marine vessel 10 to move to a position, defined by a desired global position and heading, that was previously stored in the microprocessor memory. Under those conditions, a relatively larger target linear thrust 130 and target moment 132 could be used to move the vessel 10 to the initial position when that initial position is selected from memory and the station keeping mode is enabled. As an example of this alternate embodiment, a desired position, such as the position identified by reference numeral 120 in FIG. 13, can be stored in the microprocessor and then recalled, perhaps days later, after the operator of the marine vessel 10 has moved the marine vessel to a position in the general vicinity of the stored position 120. In other words, if the operator of the marine vessel maneuvers it to a location, such as the location identified by reference numeral 121 in FIG. 13, the present invention can be enabled and activated. Under those conditions, the present invention will cause the marine vessel to move to its stored desired position 120 that was selected and saved at some previous time. This technique could possibly be advantageous in returning the marine vessel to a desirable fishing location or to a docking position after the operator has maneuvered the marine vessel into a position that is generally close to the desired position.

In a particularly preferred embodiment of the present invention, the microprocessor 116, as described above in conjunction with FIG. 11, allows the operator to manually manipulate the joystick 50 so that the marine vessel is positioned in response to the desire of the operator. As this process continues, the operator of the marine vessel may choose to release the joystick 50. At that instant in time, the station keeping mode is immediately activated, if enabled, and the marine vessel is maintained at the most recent position and heading of the vessel 10 when the joystick 50 initially became inactive as the operator released it. The operator could subsequently manipulate the joystick again to make slight corrections in the position and heading of the vessel. As that is being done, the station keeping mode of the present invention is temporarily deactivated. However, if the operator of the marine vessel again releases the joystick 50, its inactivity will trigger the resumption of the station keeping method if it had been previously enabled by the operator.

Figure 14:
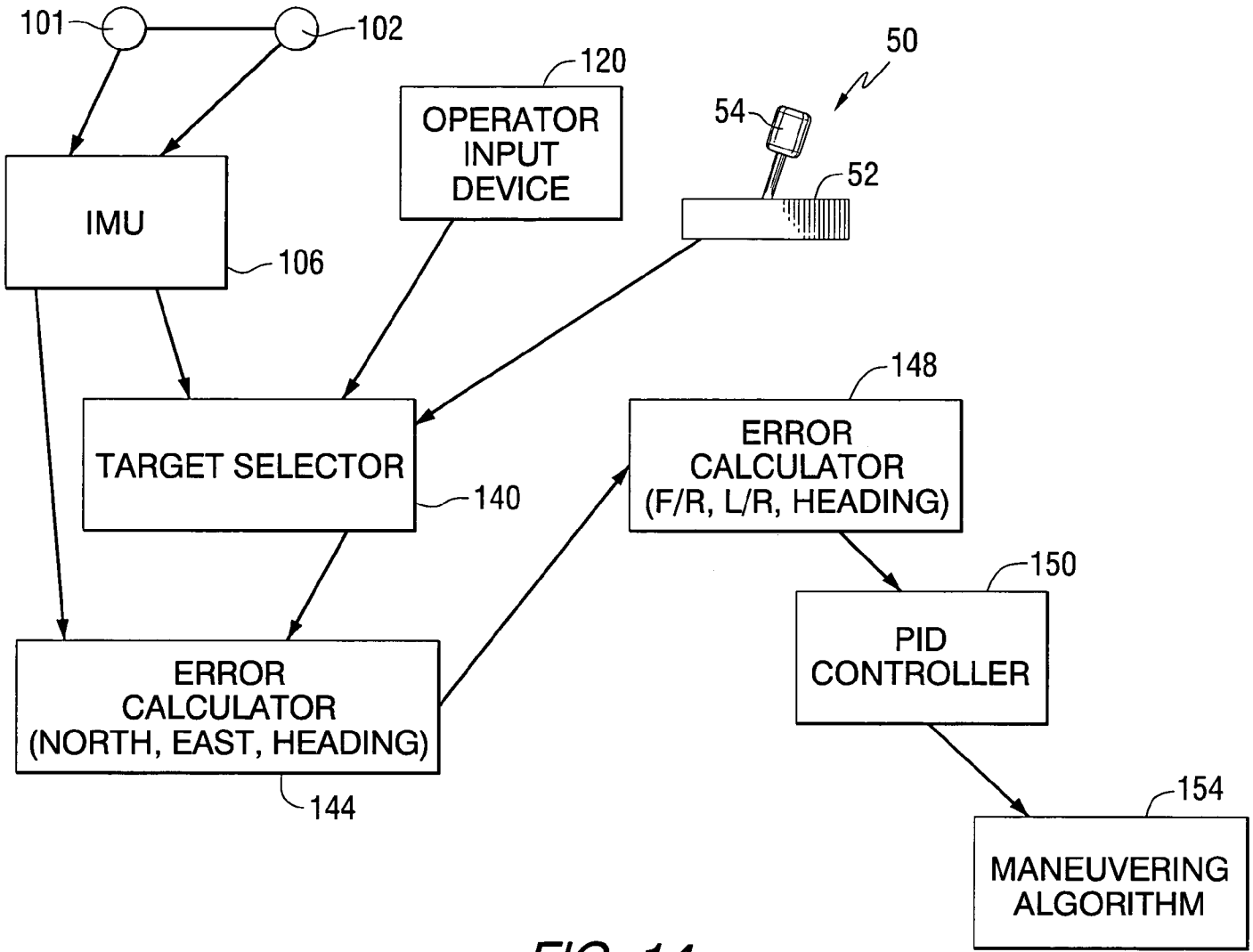
FIG. 14 is a block diagram of the functional elements of the present invention used to perform a station keeping function.

FIG. 14 is a schematic representation of the devices and software used in conjunction with the preferred embodiment of the present invention. With references to FIGS. 11-14, the inertial measurement unit (IMU) 106 receives signals from the two GPS devices, 101 and 102, and provides information to the microprocessor 116 in relation to the absolute global position and heading of the marine vessel 10 and in relation to the velocity and acceleration of the marine vessel 10 in six degrees of freedom which include forward and reverse movement of the vessel, left and right movement of the vessel, and both YAW movements of the vessel.

With continued reference to FIG. 14, a target selector portion 140 of the software receives inputs from the IMU 106, the operator input device 120, and the joystick 50. When the station keeping mode of the present invention is enabled, by an input from the operator of the marine vessel through the operator input device 120, and the joystick 50 is inactive, the target selector receives a current set of magnitudes from the IMU 106 and stores those values as the target global position and target heading for the vessel 10. A preferred embodiment of the present invention is programmed to obtain this target position information only when the station keeping mode is enabled by the device 120 and the joystick 50 initially becomes inactive after having been active. This target information is stored by the microprocessor 116.

When in the station keeping mode, the IMU 106 periodically obtains new data from the GPS devices, 101 and 102, and provides the position information to s an error calculator 144 within the microprocessor 116. This error calculator compares the target global position and target heading to current values of these two variables. That produces a difference magnitude which is defined in terms of a north-south difference and an east-west difference in combination with a heading angular difference. These are graphically represented as the target linear thrust 130 and the target moment 132. The target linear thrust 130 is the net difference in the longitude and latitude positions represented by the target position and current position. The heading difference is the angular difference between angles A2 and A1 in FIG. 13.

This information, which is described in terms of global measurements and which are in reference to stationary global references, are provided to an error calculator 148 which resolves those values into forward-reverse, left-right, and heading changes in reference to clockwise and counterclockwise movement of the marine vessel 10. These errors are provided to a PID controller 150.

As is generally known to those skilled in the art, a PID controller uses proportional, integral, and derivative techniques to maintain a measured variable at a preselected set point. Examples of this type of controller are used in cruise control systems for automobiles and temperature control systems of house thermostats. In the proportional band of the controller, the controller output is proportional to the error between the desired magnitude and the measured magnitude. The integral portion of the controller provides a controller output that is proportional to the amount of time that an error, or difference, is present. Otherwise, an offset (i.e. a deviation from set point) can cause the controller to become unstable under certain conditions. The integral portion of the controller reduces the offset. The derivative portion of the controller provides an output that is proportional to the rate of change of the measurement or of the difference between the desired magnitude and the actual current magnitude.

Each of the portions, or control strategies, of the PID controller typically use an individual gain factor so that the controller can be appropriately tuned for each particular application. It should be understood that specific types of PID controllers and specific gains for the proportional, integral, and derivative portions of the controller are not limiting to the present invention.

With continued reference to FIG. 14, the error correction information provided by the PID controller 150 is used by the maneuvering algorithm 154 which is described above in greater detail. The maneuvering algorithm receives information describing the required corrective vectors, both the linear corrective vector and the moment corrective vector, necessary to reduce the error or difference between the current global position and heading and the target global position and heading.

As described above, the method for positioning a marine vessel 10, in accordance with a particularly preferred embodiment of the present invention, comprises the steps of obtaining a measured position of the marine vessel 10. As described in conjunction with FIGS. 11-14, the measured position of the marine vessel is obtained through the use of the GPS devices 101 and 102, in cooperation with the inertial measurement unit (IMU) 106. The present invention further comprises the step of selecting a desired position of the marine vessel. This is done by a target selector 140 that responds to being placed in an enabling mode by an operator input device 120 in combination with a joystick 50 being placed in an inactive mode. When those situations occur, the target selector 140 saves the most recent magnitudes of the global position and heading provided by the IMU 106 as the target global position and target heading. A preferred embodiment of the present invention further comprises the step of determining a current position of the marine vessel 10. This is done, in conjunction with the error calculator 144, by saving the most recent magnitude received from the IMU 106. The present invention further comprises the step of calculating a difference between the desired and current positions of the marine vessel. These differences, in a particularly preferred embodiment of the present invention, are represented by the differences, in longitude and latitude positions, of the center of gravity 12 of the marine vessel between the desired and current positions. The preferred embodiment of the present invention then determines the required movements to reduce the magnitude of that difference. This is done through the use of a PID controller 150. Once these movements are determined, the first and second marine propulsion devices are used to maneuver the marine vessel 10 in such a way that it achieves the required movements to reduce the difference between the desired position and the current position. The steps used efficiently and accurately maneuver the marine vessel 10 in response to these requirements is described above in detail in conjunction with FIGS. 1-10.

With reference to FIGS. 11 and 14, it should be understood that an alternative embodiment of the present invention could replace the two GPS devices, 101 and 102, with a single GPS device that provides information concerning the global position, in terms of longitude and latitude, of the marine vessel 10. This single GPS device could be used in combination with an electronic compass which provides heading information, as represented by arrow 110, pertaining to the marine vessel 10. In other words, it is not necessary in all embodiments of the present invention to utilize two GPS devices to provide both global position and heading information. In the particularly preferred embodiment of the present invention described above, the two GPS devices work in cooperation with the IMU 106 to provide additional information beyond the global position. In addition to providing information relating to the heading of the marine vessel 10, as represented by arrow 110, the two GPS devices in association with the IMU 106 provide additional information as described above in greater detail. Alternative embodiments, which utilize a single GPS device in cooperation with an electronic compass, are also within the scope of the present invention. In fact, any combination of devices that is able to provide information identifying the global position and heading of the marine vessel 10 can be used in conjunction with the present invention.

With continued reference to FIGS. 11 and 14, it should also be understood that the IMU 106 could be used as a separate unit which provides data into another device, or vice versa, for the purpose of providing information relating to position and heading correction information. It should therefore be clearly understood that alternative configurations of the IMU 106 and microprocessor 116 could be used in conjunction with the present invention as long as the system is able to provide information relating to the appropriate corrections necessary to cause the marine vessel 10 to move toward a desired position in such a way that its center of gravity 12 remains at its desired position and the heading, as represented by arrow 110, is maintained at the desired heading position of the marine vessel. Many different embodiments can be incorporated in the marine vessel 10 for the purposes of providing the information relating to the global position, the heading of marine vessel 10, and the appropriate thrust vectors necessary to achieve an effective correction of the position and heading of the marine vessel so that it remains at the desired position.

Although the present invention has been described in particular detail and illustrated to show a preferred embodiment, it should be understood that alternative embodiments are also within its scope.

The invention claimed is:

1. A method for maintaining a marine vessel in a selected position, comprising the steps of:

providing a first marine propulsion device which is rotatable about a first steering axis;

providing a second marine propulsion device which is rotatable about a second steering axis;

determining a current global position of said marine vessel;

determining a current heading of said marine vessel;

receiving a signal command to maintain the current global position and the current heading of said marine vessel;

storing said current global position and heading of said marine vessel as a target global position and a target heading in response to receiving said signal command;

determining a subsequent global position of said marine vessel;

determining a subsequent heading of said marine vessel;

calculating a position error difference between said subsequent global position and said target global position;

calculating a heading error difference between said subsequent heading and said target heading;

determining required marine vessel movements to minimize said position error difference and said heading error difference;

resolving said required marine vessel movements into a target linear thrust and a target moment about a preselected point of said marine vessel;

determining a first rotational position of said first marine propulsion device about said first steering axis, a second rotational position of said second marine propulsion device about said second steering axis, a first magnitude and first direction of thrust for said first marine propulsion device, and a second magnitude and second direction of thrust for said second marine propulsion device which will result in achievement of said target linear thrust and said target moment about said preselected point of said marine vessel;

rotating said first and second marine propulsion devices to said first and second rotational positions about said first and second steering axes, respectively;

causing said first and second marine propulsion devices to produce said first and second magnitudes and directions of thrust, respectively; and providing a manually operable control device which is configured to provide an output signal which is representative of a desired movement of said marine vessel, said signal command receiving step being performed only upon an initial change from activity to inactivity of said manually operable control device.

2. The method of claim 1, wherein:

said steps of calculating a position error difference, calculating a heading error difference, and determining the required marine vessel movements to minimize said position error difference and said heading error difference are only performed when said manually operable control device is inactive.

3. The method of claim 1, wherein:

said step of resolving said required marine vessel movements into a target linear thrust and a target moment about a preselected point of said marine vessel is only performed when said manually operable control device is inactive.

4. The method of claim 1, further comprising:

providing a station keeping mode maintaining said vessel in a selected position comprising providing first and second GPS, global positioning system, devices each located at a preselected fixed position on said vessel and supplying GPS signals.

5. The method of claim 4, comprising providing said GPS signals from said first and second GPS devices to an IMU, inertial measurement unit, and supplying information from said IMU including longitude, latitude, and heading of said vessel.

6. The method of claim 1, wherein:

said first and second internal combustion engines are the sole providers or torque to said first and second marine propulsion devices, respectively.

7. The method of claim 1, wherein:

said first and second rotational positions result in said first and second marine propulsion devices producing first and second thrust vectors which intersect at a point located on a centerline which extends from a bow to a stern of said marine vessel.

8. The method of claim 7, wherein:

said first and second thrust vectors intersect at said preselected point of said marine vessel when said target moment is equal to zero.

9. The method of claim 7, wherein:

said first and second thrust vectors intersect at a point on said centerline other than said preselected point of said marine vessel when said target moment has an absolute value greater than zero.

10. The method of claim 7, wherein:

said first and second rotational positions of said first and second marine propulsion devices are symmetrical about said centerline.

11. The method of claim 1, wherein:

said manually operable control device is a joystick.

12. The method of claim 1, wherein:

said first marine propulsion device is located on a port side of said centerline and said second marine propulsion device is located on a starboard side of said centerline.

13. The method of claim 12, wherein:

said first marine propulsion device comprises a first propeller attached to a rear portion of said first marine propulsion device to provide a pushing thrust on said first marine propulsion device when said first propeller is rotated in a forward direction; and said second marine propulsion device comprises a second propeller attached to a rear portion of said second marine propulsion device to provide a pushing thrust on said second marine propulsion device when said second propeller is rotated in a forward direction.

14. The method of claim 1, wherein:

said first and second steering axes are generally parallel to each other.

15. The method of claim 1, wherein:

said preselected point of said marine vessel is a center of gravity of said marine vessel.

16. A method for positioning a marine vessel, comprising the steps of:

obtaining a measured position of said marine vessel;

selecting a desired position of said marine vessel;

determining a current position of said marine vessel;

calculating a difference between said desired and current positions of said marine vessel;

determining required movements of said marine vessel to reduce said difference;

providing a first marine propulsion device which is rotatable about a first steering axis;

providing a second marine propulsion device which is rotatable about a second steering axis;

maneuvering said marine vessel to achieve said required movements; and providing a manually operable control device which is configured to provide an output signal which is representative of a marine vessel movement command, said manually operable control device having an active state during which it is being manually manipulated and an inactive state when it is not being manually manipulated.

17. The method of claim 16, wherein:

said maneuvering step comprises the steps of resolving said required movements of said marine vessel into a target linear thrust and a target moment about a preselected point of said marine vessel;

determining a first rotational position of said first marine propulsion device about said first vertical steering axis, a second rotational position of said second marine propulsion device about said second vertical steering axis, a first magnitude and first direction of thrust for said first marine propulsion device, and a second magnitude and second direction of thrust for said second marine propulsion device which will result in achievement of said target linear thrust and said target moment about said preselected point of said marine vessel; and rotating said first and second marine propulsion devices to said first and second rotational positions about said first and second vertical steering axes, respectively.

18. The method of claim 17, further comprising:

causing said first and second marine propulsion devices to produce said first and second magnitudes and directions of thrust, respectively, said first and second rotational positions resulting in said first and second marine propulsion devices producing first and second thrust vectors which intersect at a point located on a centerline which extends from a bow to a stem of said marine vessel.

19. The method of claim 18, wherein:

said first and second thrust vectors intersect at said preselected point of said marine vessel when said target moment is equal to zero, said preselected point of said marine vessel being a center of gravity of said marine vessel.

20. The method of claim 19, wherein:

said first and second thrust vectors intersect at a point on said centerline other than said preselected point of said marine vessel when said target moment has an absolute value greater than zero.

21. The method of claim 18, wherein:

said manually operable control device is a joystick.

22. The method of claim 17, wherein:

said first and second rotational positions of said first and second marine propulsion devices are symmetrical about said centerline.

23. The method of claim 16, wherein:

said measured, desired, and current positions of said marine vessel are each defined in relation to a global position and a heading of said marine vessel.

24. The method of claim 23, wherein:

said first steering axis is generally vertical and extends through a hull surface of said marine vessel; and said second steering axis is generally vertical and extends through said hull surface of said marine vessel.

25. The method of claim 16, further comprising:

receiving a manually selectable enable command, said step of maneuvering said marine vessel to achieve said required movements only being performed when said enable command is selected and said status of said manually operable control device is inactive.

26. The method of claim 25, wherein:

said measured position is saved as said desired position when said status of said manually operable control device initially changes from active to inactive when said enable command is selected.

27. The method of claim 16, wherein:

said obtaining step is performed periodically.

28. The method of claim 16, further comprising:

providing a station keeping mode maintaining said vessel in a selected position comprising providing first and second GPS, global positioning system, devices each located at a preselected fixed position on said vessel and supplying GPS signals.

29. The method of claim 28, wherein:

said first and second internal combustion engines are the sole providers of torque to said first and second marine propulsion devices, respectively.

30. The method of claim 28, comprising providing said GPS signals from said first and second GPS devices to an IMU, inertial measurement unit, and supplying information from said IMU including longitude, latitude, and heading of said vessel.

31. The method of claim 16, wherein:

said first marine propulsion device comprises a first propeller attached to a rear portion of said first marine propulsion device to provide a pushing thrust on said first marine propulsion device when said first propeller is rotated in a forward direction; and said second marine propulsion device comprises a second propeller attached to a rear portion of said second marine propulsion device to provide a pushing thrust on said second marine propulsion device when said second propeller is rotated in a forward direction.

32. A method for positioning a marine vessel, comprising the steps of:

obtaining a measured position of said marine vessel;

selecting a desired position of said marine vessel in response to receiving a manually provided input signal;

determining a current position of said marine vessel by storing a recent magnitude of said measured position, said measured, desired, and current positions of said marine vessel each being defined in relation to a global position and a heading of said marine vessel;

calculating a difference between said desired and current positions of said marine vessel;

determining a required movement of said marine vessel which reduces said difference;

providing a first marine propulsion device which is rotatable about a first steering axis;

providing a second marine propulsion device which is rotatable about a second steering axis;

providing a first internal combustion engine disposed within said hull of said marine vessel and connected in torque transmitting relation with said first marine propulsion device; and providing a second internal combustion engine disposed within said hull of said marine vessel and connected in torque transmitting relation with said second marine propulsion device, said first and second internal combustion engines being the sole providers or torque to said first and second marine propulsion devices, respectively;

maneuvering said marine vessel to achieve said required movements; and providing a manually operable control device which is configured to provide an output signal which is representative of a marine vessel movement command, said manually operable control device having an active state during which it is being manually manipulated and an inactive state when it is not being manually manipulated.

33. The method of claim 32, wherein:

said maneuvering step comprises the steps of resolving said required movements of said marine vessel into a target linear thrust and a target moment about a preselected point of said marine vessel;

determining a first rotational position of said first marine propulsion device about said first vertical steering axis, a second rotational position of said second marine propulsion device about said second vertical steering axis, a first magnitude and first direction of thrust for said first marine propulsion device, and a second magnitude and second direction of thrust for said second marine propulsion device which will result in achievement of said target linear thrust and said target moment about said preselected point of said marine vessel; and rotating said first and second marine propulsion devices to said first and second rotational positions about said first and second vertical steering axes, respectively.

34. The method of claim 33, further comprising:

causing said first and second marine propulsion devices to produce said first and second magnitudes and directions of thrust, respectively, said first and second rotational positions resulting in said first and second marine propulsion devices producing first and second thrust vectors which intersect at a point located on a centerline which extends from a bow to a stern of said marine vessel.

35. The method of claim 34, wherein:

said first steering axis is generally vertical and extends through a hull surface of said marine vessel; and said second steering axis is generally vertical and extends through said hull surface of said marine vessel.

36. The method of claim 32, further comprising:

receiving a manually selectable enable command, said step of maneuvering said marine vessel to achieve said required movements only being performed when said enable command is selected and said status of said manually operable control device is inactive.

37. The method of claim 36, wherein:

said obtaining step is performed periodically, said measured position being saved as said desired position when said status of said manually operable control device initially changes from active to inactive when said enable command is selected.

38. The method of claim 37, wherein:

said first and second thrust vectors intersect at said preselected point of said marine vessel when said target moment is equal to zero, said preselected point of said marine vessel being a center of gravity of said marine vessel; and said first and second thrust vectors intersect at a point on said centerline other than said preselected point of said marine vessel when said target moment has an absolute value greater than zero.

39. The method of claim 38, wherein:

said manually operable control device is a joystick.

40. The method of claim 32 comprising providing a station keeping mode maintaining said vessel in a selected position comprising providing first and second GPS, global positioning system, devices each located at a preselected fixed position on said vessel and supplying GPS signals.

41. The method of claim 40 comprising providing said GPS signals from said first and second GPS devices to an IMU, inertial measurement unit, and supplying information from said IMU including longitude, latitude, and heading of said vessel.

42. A method for positioning a marine vessel, comprising the steps of:

obtaining a measured position of said marine vessel;

selecting a desired position of said marine vessel in response to receiving a manually provided input signal;

determining a current position of said marine vessel by storing a recent magnitude of said measured position, said measured, desired, and current positions of said marine vessel each being defined in relation to a global position and a heading of said marine vessel;

calculating a difference between said desired and current positions of said marine vessel;

determining a required movement of said marine vessel which reduces-said difference;

providing a first marine propulsion device which is rotatable about a first steering axis;

providing a second marine propulsion device which is rotatable about a second steering axis;

providing a first internal combustion engine disposed within said hull of said marine vessel and connected in torque transmitting relation with said first marine propulsion device; and providing a second internal combustion engine disposed within said hull of said marine vessel and connected in torque transmitting relation with said second marine propulsion device, said first and second internal combustion engines being the sole providers or torque to said first and second marine propulsion devices, respectively;

providing a manually operable control device which is configured to provide an output signal which is representative of a marine vessel movement command, said manually operable control device having an active state during which it is being manually manipulated and an inactive state when it is not being manually manipulated; and resolving said required movements of said marine vessel into a target linear thrust and a target moment about a preselected point of said marine vessel;

determining a first rotational position of said first marine propulsion device about said first vertical steering axis, a second rotational position of said second marine propulsion device about said second vertical steering axis, a first magnitude and first direction of thrust for said first marine propulsion device, and a second magnitude and second direction of thrust for said second marine propulsion device which will result in achievement of said target linear thrust and said target moment about said preselected point of said marine vessel; and rotating said first and second marine propulsion devices to said first and second rotational positions about said first and second vertical steering axes, respectively; and causing said first and second marine propulsion devices to produce said first and second magnitudes and directions of thrust, respectively, said first and second rotational positions resulting in said first and second marine propulsion devices producing first and second thrust vectors which intersect at a point located on a centerline which extends from a bow to a stem of said marine vessel, said step of selecting a desired position of said marine vessel is only performed when said status of said manually operable control device initially changes from active to inactive.

43. The method of claim 42, wherein:

said first steering axis is generally vertical and extends through a hull surface of said marine vessel; and said second steering axis is generally vertical and extends through said hull surface of said marine vessel.

44. The method of claim 43, further comprising:

receiving a manually selectable enable command from said manually operable control device, said steps of rotating and causing only being performed when said enable command is selected and said status of said manually operable control device is inactive.

45. The method of claim 44, wherein:

said obtaining step is performed periodically, said measured position being saved as said desired position when said status of said manually operable control device initially changes from active to inactive when said enable command is selected.

46. The method of claim 42, wherein:

said first and second thrust vectors intersect at said preselected point of said marine vessel when said target moment is equal to zero, said preselected point of said marine vessel being a center of gravity of said marine vessel; and said first and second thrust vectors intersect at a point on said centerline other than said preselected point of said marine vessel when said target moment has an absolute value greater than zero, said manually operable control device being a joystick.

47. The method of claim 42 comprising providing a station keeping mode maintaining said vessel in a selected position comprising providing first and second GPS, global positioning system, devices each located at a preselected fixed position on said vessel and supplying GPS signals.

48. The method of claim 47 comprising providing said GPS signals from said first and second GPS devices to an IMU, inertial measurement unit, and supplying information from said IMU including longitude, latitude, and heading of said vessel.

49. A method for positioning a marine vessel, comprising the steps of:

obtaining a measured position of said marine vessel;

selecting a desired position of said marine vessel;

determining a current position of said marine vessel, said measured, desired, and current positions of said marine vessel each being defined in relation to a global position and a heading of said marine vessel;

calculating a difference between said desired and current positions of said marine vessel;

determining required movements of said marine vessel to reduce-said difference;

providing a first marine propulsion device which is rotatable about a first steering axis;

providing a second marine propulsion device which is rotatable about a second steering axis, said first and second steering axes each being generally vertical and extending through a hull surface of said marine vessel, said first marine propulsion device comprising a first propeller attached to a rear portion of said first marine propulsion device to provide a pushing thrust on said first marine propulsion device when said first propeller is rotated in a forward direction, said second marine propulsion device comprising a second propeller attached to a rear portion of said second marine propulsion device to provide a pushing thrust on said second marine propulsion device when said second propeller is rotated in a forward direction;

providing a first internal combustion engine disposed within said hull of said marine vessel and connected in torque transmitting relation with said first marine propulsion device;

providing a second internal combustion engine disposed within said hull of said marine vessel and connected in torque transmitting relation with said second marine propulsion device, said first and second internal combustion engines being the sole providers or torque to said first and second marine propulsion devices, respectively;

providing a joystick which is configured to provide an output signal which is representative of a marine vessel movement command, said joystick having an active state during which it is being manually manipulated and an inactive state when it is not being manually manipulated, said step of selecting a desired position of said marine vessel only being performed when said status of said joystick initially changes from active to inactive, said measured position being saved as said desired position when said status of said joystick initially changes from active to inactive when said enable command is selected; and maneuvering said marine vessel to achieve said required movements.

50. The method of claim 49, wherein:

said maneuvering step comprises the steps of resolving said required movements of said marine vessel into a target linear thrust and a target moment about a preselected point of said marine vessel;

determining a first rotational position of said first marine propulsion device about said first vertical steering axis, a second rotational position of said second marine propulsion device about said second vertical steering axis, a first magnitude and first direction of thrust for said first marine propulsion device, and a second magnitude and second direction of thrust for said second marine propulsion device which will result in achievement of said target linear thrust and said target moment about said preselected point of said marine vessel;

rotating said first and second marine propulsion devices to said first and second rotational positions about said first and second vertical steering axes, respectively; and causing said first and second marine propulsion devices to produce said first and second magnitudes and directions of thrust, respectively, said first and second rotational positions resulting in said first and second marine propulsion devices producing first and second thrust vectors which intersect at a point located on a centerline which extends from a bow to a stem of said marine vessel.

51. The method of claim 50, further comprising:

receiving a manually selectable enable command, said step of maneuvering said marine vessel to achieve said required movements only being performed when said enable command is selected and said status of said joystick is inactive.

52. The method of claim 49 comprising providing a station keeping mode maintaining said vessel in a selected position comprising providing first and second GPS, global positioning system, devices each located at a preselected fixed position on said vessel and supplying GPS signals.

53. The method of claim 52 comprising providing said GPS signals from said first and second GPS devices to an IMU, inertial measurement unit, and supplying information from said IMU including longitude, latitude, and heading of said vessel.

* * * * *